US011680583B2

(12) United States Patent
Sato et al.

(10) Patent No.: US 11,680,583 B2
(45) Date of Patent: Jun. 20, 2023

(54) CONSTRUCTION MACHINE

(71) Applicant: Hitachi Construction Machinery Co., Ltd., Tokyo (JP)

(72) Inventors: Daiwa Sato, Tokyo (JP); Kazuya Kusano, Tokyo (JP); Hitoshi Nishiguchi, Tsuchiura (JP); Kunihiko Ikeda, Tsuchiura (JP); Kenichi Hano, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/284,507

(22) PCT Filed: Oct. 10, 2019

(86) PCT No.: PCT/JP2019/040101

§ 371 (c)(1),
(2) Date: Apr. 12, 2021

(87) PCT Pub. No.: WO2020/080260

PCT Pub. Date: Apr. 23, 2020

(65) Prior Publication Data

US 2021/0372431 A1 Dec. 2, 2021

(30) Foreign Application Priority Data

Oct. 15, 2018 (JP) ..... JP2018-194562

(51) Int. Cl.
*F04D 29/42* (2006.01)
*F04D 29/28* (2006.01)
(Continued)

(52) U.S. Cl.
CPC ..... *F04D 29/4226* (2013.01); *F04D 29/281* (2013.01); *F04D 29/30* (2013.01); *F04D 29/441* (2013.01)

(58) Field of Classification Search
CPC .... F04D 29/281; F04D 29/30; F04D 29/4226; F04D 29/441
See application file for complete search history.

(56) References Cited

U.S. PATENT DOCUMENTS 5,839,397 A * 11/1998 Funabashi ..... E02F 9/0866 415/206
8,668,460 B2 * 3/2014 Han ..... F04D 29/30 416/241 R
(Continued)

FOREIGN PATENT DOCUMENTS

CN 102459917 A 5/2012
JP 8-303241 A 11/1996
(Continued)

OTHER PUBLICATIONS

International Preliminary Report on Patentability (PCT/IB/338 & PCT/IB/373) issued in PCT Application No. PCT/JP2019/040101 dated Apr. 29, 2021, Including English translation (Japanese-language Written Opinion (PCT/ISA/237), filed on Apr. 12, 2021) (10 pages).
(Continued)

*Primary Examiner* — J. Todd Newton
*Assistant Examiner* — Behnoush Haghighian
(74) *Attorney, Agent, or Firm* — Crowell & Moring LLP

(57) ABSTRACT

A construction machine includes a centrifugal fan, and a bell mouth arranged on the suction side of the centrifugal fan. The centrifugal fan has a rotatable hub, an annular shroud arranged so as to face the hub and having a suction port, and multiple blades provided between the hub and the shroud. An outlet of the bell mouth is arranged on the radially inner side of the suction port of the shroud. Each blade is formed such that: a leading edge has a convex shape protruding toward a suction surface relative to a line segment linking a connection of the leading edge with the hub and a connec-
(Continued)

tion of the leading edge with the shroud; and a vertex of the convex shape of the leading edge is positioned on a radially inner side of a wall surface of the outlet of the bell mouth when the suction side of the centrifugal fan is seen in an axis direction.

6 Claims, 14 Drawing Sheets

(51) Int. Cl.
*F04D 29/30* (2006.01)
*F04D 29/44* (2006.01)

(56) References Cited

U.S. PATENT DOCUMENTS 8,834,121 B2 * 9/2014 Ikeda ..... F04D 25/088 416/243
9,157,450 B2 * 10/2015 Sugimura ..... F04D 29/284
9,234,524 B2 * 1/2016 Shoji ..... F04D 29/30
9,267,511 B2 * 2/2016 Ikeda ..... F04D 29/30
9,651,056 B2 * 5/2017 Ikeda ..... F04D 29/242
9,829,004 B2 * 11/2017 Ikeda ..... F04D 29/384
10,563,657 B2 * 2/2020 Kang ..... F04D 29/023
2007/0251168 A1 11/2007 Kinoshita
2007/0251680 A1 * 11/2007 Kinoshita ..... F04D 29/282 165/145
2011/0023526 A1 * 2/2011 Ohyama ..... F04D 29/30 416/223 R
2012/0055656 A1 * 3/2012 Han ..... F04D 29/30 165/122
2012/0063899 A1 * 3/2012 Ikeda ..... F04D 29/245 416/185
2012/0263599 A1 * 10/2012 Sugimura ..... F04D 29/30 416/223 R
2012/0328420 A1 * 12/2012 Ikeda ..... F04D 29/30 415/177
2013/0149157 A1 * 6/2013 Shoji ..... F04D 29/281 416/182
2015/0030454 A1 * 1/2015 Ikeda ..... F04D 29/667 416/186 R

FOREIGN PATENT DOCUMENTS

JP 9-112268 A 4/1997
JP 2003-65294 A 3/2003
JP 2009-174541 A 8/2009
WO WO 2006/006668 A1 1/2006
WO WO 2009/139422 A1 11/2009
WO WO 2017/207293 A1 12/2017

OTHER PUBLICATIONS

International Search Report (PCT/ISA/210) issued in PCT Application No. PCT/JP2019/040101 dated Dec. 17, 2019 with English translation (four (4) pages).
Japanese-language Written Opinion (PCT/ISA/237) issued in PCT Application No. PCT/JP2019/040101 dated Dec. 17, 2019 (six (6) pages).
Chinese-language Office Action issued in Chinese Application No. 201980065819.7 dated May 25, 2022 with English translation (16 pages).
Extended European Search Report issued in European Application No. 19874021 dated Jun. 13, 2022 (seven (7) pages).

* cited by examiner

CONSTRUCTION MACHINE

TECHNICAL FIELD

The present invention relates to a construction machine, and more specifically relates to a construction machine on which a centrifugal fan is mounted.

BACKGROUND ART

In construction machines such as hydraulic excavators or dump trucks, various types of equipment such as an engine or a heat exchanger are cooled by cooling air generated by a cooling fan. A large number of units of equipment and parts are arranged inside a construction machine in a state in which they are densely located. When cooling air is supplied to such a region, the pressure loss of the cooling air increases, and thus a centrifugal fan is adopted as a cooling fan in some cases. Typically, a centrifugal fan can produce a larger pressure increase than an axial fan can at the same revolution speed.

A centrifugal fan includes: a disk-like hub (main plate) attached to a rotational drive shaft; a plurality of blades each of which has one end side that is fixed to an outer circumferential portion of the hub at intervals from adjacent blades in the circumferential direction; and a ring-like shroud (side plate) that is attached to the other end sides of the plurality of blades opposite to the hub described above, and form an air suction port on one side. Such centrifugal fans include ones that are intended to exhibit effective blade performance by forming smooth flows on both surfaces of each blade (see Patent Document 1, for example).

In a centrifugal fan described in Patent Document 1, a shroud is formed to have a cross-section which is an arc shape inclined at a predetermined curvature from an air suction port on the middle side toward the centrifugal direction on the outer circumference side, and a shroud-side end portion of each blade between a hub and the shroud is curved in a direction opposite to rotation. With the configuration described above, the cross-sectional area of a corner section formed between an airflow guide surface on the inner side of the shroud and a pressure surface of each blade is increased as compared to a case in which each blade extends approximately linearly from a hub to a shroud and is connected therewith, and a dead-water-region reducing space is formed. In addition, in the centrifugal fan described in Patent Document 1, a bell mouth is installed on the suction side of the centrifugal fan in order to guide air to the air suction port of the centrifugal fan smoothly. The bell mouth is arranged in a state in which an end portion of an air outlet on the downstream side is loosely fit inside an air suction port of the shroud.

PRIOR ART DOCUMENT

Patent Document

Patent Document 1: JP-2009-174541-A

SUMMARY OF THE INVENTION

Problem to be Solved by the Invention

Since centrifugal fans pressurize air by suctioning air from the axis direction and discharging the air radially outward, the flow of the air inside the fans is caused to turn suddenly. The airflow is pressed toward a hub by an inertial force when the airflow having been flowing in the axis direction is caused to turn radially outward. In addition, airflow on the side of a shroud needs to be turned at a curvature larger than the curvature of airflow on the side of the hub, but the airflow on the side of the shroud does not sufficiently follow the wall-surface shape of the shroud and is pressed toward the hub. This creates, at a position where the direction of airflow is turned in a radial direction to some extent, a non-uniform flow velocity distribution in which the speed of airflow on the side of the hub becomes higher than the speed of airflow on the side of the shroud, in the span direction of a blade (the direction from one side of the blade closer to the hub toward the other side of the blade closer to the shroud). If the flow rate difference between the hub side and the shroud side increases, the airflow is undesirably separated from the shroud. Since the effective flow path area inside the centrifugal fan decreases in this case, the performance of the centrifugal fan deteriorates.

Examples of methods of making the flow velocity distribution in the span direction of a blade uniform include one configuration in which the curvature of a shroud of a centrifugal fan is reduced to cause airflow to follow the inner wall surface of the shroud. However, other than an engine or a heat exchanger, various units of equipment and parts also are housed inside a construction machine, and there is only a limited installation space for a centrifugal fan. Accordingly, a centrifugal fan which is as thin as possible (is short in the axis direction) is demanded, and it is difficult to use a shroud that has a small curvature and curves more gradually because it leads to a size increase in the centrifugal fan.

In addition, the examples of methods of making the flow velocity distribution in the span direction of a blade uniform include another configuration in which the flow-path length of a centrifugal fan in the radial direction is made long. However, typically in a construction machine, a heat exchanger is installed upstream of a centrifugal fan, and it is necessary to increase the area of a suction port of the centrifugal fan as much as possible in order to cool the heat exchanger efficiently. Furthermore, since there is only a limited installation space in a construction machine for a centrifugal fan as mentioned before, the outer diameter of the centrifugal fan also is restricted according to the installation space. If the area of the suction port of the centrifugal fan is increased, by a corresponding amount, the distance from the opening edge of the suction port of the centrifugal fan to the outer periphery on the discharge side becomes short. Accordingly, it is difficult to lengthen the flow-path length in the radial direction of the centrifugal fan whose outer diameter is restricted.

Meanwhile, construction machines on which centrifugal fans are mounted include ones in which, similarly to the centrifugal fan described in Patent Document 1, a bell mouth is installed on the suction side of a centrifugal fan, and an air outlet of the bell mouth is arranged on the inner-circumference side of an air suction port of a shroud of the centrifugal fan. In the bell mouth having a diameter that becomes smaller toward the centrifugal fan, the speed of air that flows out from an air outlet of the bell mouth becomes higher on the side of the wall surface of the bell mouth (the radially outer side) than on the center side of the bell mouth (the radially inner side).

In addition, there is a clearance provided between the centrifugal fan rotated and the bell mouth being stationary such that the centrifugal fan and the bell mouth do not contact each other. Part of air discharged from the centrifugal fan passes through the clearance, and flows again into the centrifugal fan as a leakage flow. Taking vibrations of a machine body of a construction machine at the time of operation, and the like into consideration, a centrifugal fan mounted on the construction machine needs to have a larger clearance between the centrifugal fan and a bell mouth as compared to a centrifugal fan that is applied to a ceiling-embedded air conditioner like the one described in Patent Document 1. The larger the clearance is, the larger the amount of a leakage flow to flow into the centrifugal fan is.

Due to the influence of such a wall-surface shape of a bell mouth, and the influence of a leakage flow, a flow of air flowing into an air suction port of a centrifugal fan has a higher speed in the vicinity of the wall surface of a shroud than in a central portion of the air suction port. That is, the air that flows into the air suction port is locally accelerated in the vicinity of the wall surface of the shroud. Accordingly, the flow of air in the vicinity of the wall surface of the shroud has an inertial force which is larger by an amount corresponding to the acceleration of the speed at the time when the flow of air having been flowing in the axis direction is caused to turn radially outward, and thus it is pressed more toward a hub. Accordingly, in a centrifugal fan in which a bell mouth is installed on the suction side, there is a flow velocity distribution in which the speed difference between airflow on the side of a hub and airflow on the side of a shroud increases further, in the span direction at a position where the direction of airflow has been turned in the radial direction to some extent. In such a flow velocity distribution, the airflow gets separated from the shroud more easily.

It can be known from the above that in order to enhance the performance of a centrifugal fan mounted on a construction machine, it is necessary to mitigate a non-uniform flow velocity distribution in the span direction of a blade in which the speed of airflow on the side of a hub becomes higher than the speed of airflow on the side of a shroud.

In the centrifugal fan described in Patent Document 1, the shroud-side end portion of each blade is curved in a direction opposite to rotation to thereby expand the cross-sectional area of a corner section formed between an airflow guide surface of the inner surface of the shroud and the pressure surface of the blade. However, it is considered that the configuration in which the cross-sectional area of a specific partial region on the side of the shroud like the corner section is expanded can only locally suppress the non-uniformity of airflow from the side of the shroud to the side of the hub that occurs when the airflow having been flowing in the axis direction is turned in the radial direction.

The present invention has been made in order to overcome the problems described above, and an object of the present invention is to provide a construction machine that makes it possible to mitigate a non-uniform flow velocity distribution in which the speed of airflow on the side of a hub becomes higher than the speed of airflow on the side of a shroud, in the span direction of a blade in a centrifugal fan.

Means for Solving the Problem

The present application includes a plurality of means for solving the problem described above, and one example thereof is a construction machine including: a centrifugal fan housed inside a machine body; and a bell mouth that is arranged on a suction side of the centrifugal fan, and has an outlet. The centrifugal fan includes a hub that is rotatable around a rotation axis; an annular shroud that is arranged so as to face the hub, forms a flow path between the shroud and the hub, and has a suction port; and a plurality of blades provided between the hub and the shroud at intervals in a circumferential direction. Each of the plurality of blades includes a leading edge on a side where air flows in; a trailing edge on a side where air flows out; a pressure surface that is one of blade surfaces extending between the leading edge and the trailing edge, and faces forward relative to a rotation direction; and a suction surface that is another of the blade surfaces extending between the leading edge and the trailing edge, and faces backward relative to the rotation direction. The outlet of the bell mouth is arranged on a radially inner side of the suction port of the shroud. Each of the plurality of blades is formed such that: the leading edge has a convex shape protruding toward the suction surface relative to a line segment linking a connection of the leading edge with the hub and a connection of the leading edge with the shroud; and a vertex of the convex shape of the leading edge is positioned on a radially inner side of a wall surface of the outlet of the bell mouth when the suction side of the centrifugal fan is seen in an axis direction.

Advantages of the Invention

According to the present invention, since the blades of the centrifugal fan are formed such that the vertex of the convex shape protruding toward the suction surface at the leading edge of each blade is positioned on the radially inner side of the wall surface of the outlet of the bell mouth when seen in the axis direction, it is possible to suppress the movement, toward the hub, of a flow of air having flowed from the vicinity of the wall surface of the bell mouth into the centrifugal fan, caused by an inertial force when the flow of air is turned radially outwardly. As a result, in the centrifugal fan mounted on the construction machine, it is possible to mitigate the flow velocity distribution in the span direction of the blade that has a tendency that the speed of airflow on the side of the hub becomes higher than the speed of airflow on the side of the shroud.

Problems, configurations and advantages other than those described above will become apparent from the following explanation of embodiments.

MODES FOR CARRYING OUT THE INVENTION

In the following, embodiments of a construction machine according to the present invention are explained by using the drawings. In the present embodiments, a hydraulic excavator is explained as one example of construction machines.

Figure 1:
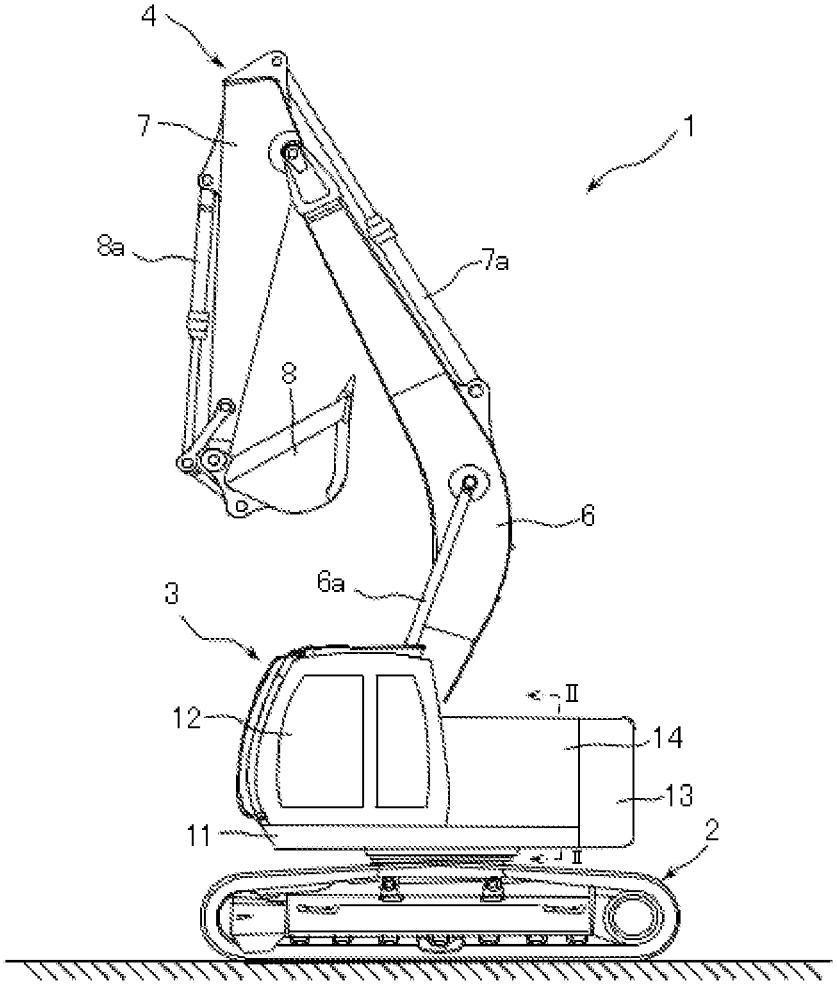
FIG. 1 is a side view illustrating a hydraulic excavator as a construction machine according to a first embodiment of the present invention.
Figure 2:
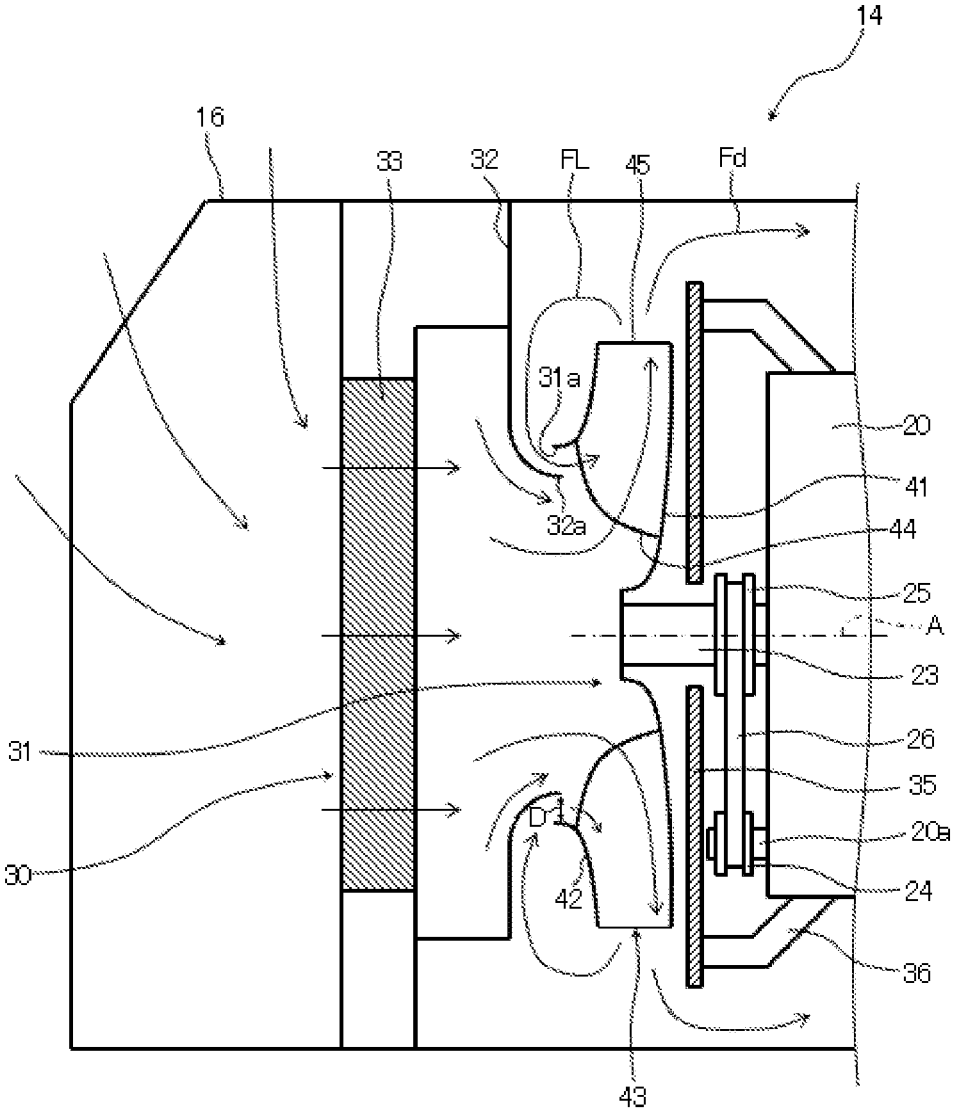
FIG. 2 is a partial cross-sectional view of the hydraulic excavator illustrated in FIG. 1 taken along arrows II-II, and is a figure illustrating the inside of a machine room of the hydraulic excavator in a state in which part of the machine room is omitted.

First, the configuration of the hydraulic excavator as a construction machine according to a first embodiment of the present invention is explained by using FIG. 1 and FIG. 2. FIG. 1 is a side view illustrating the hydraulic excavator as the construction machine according to the first embodiment of the present invention. FIG. 2 is a partial cross-sectional view of the hydraulic excavator illustrated in FIG. 1 taken along arrows II-II, and is a figure illustrating the inside of a machine room of the hydraulic excavator in a state in which part of the machine room is omitted. Here, explanations are given by using directions as seen from an operator seated on the operator's seat. In FIG. 2, thick arrows represent flows of air.

In FIG. 1, a hydraulic excavator 1 includes a crawler-type lower travel structure 2 that can travel in an automated manner, and an upper swing structure 3 that is swingably mounted on the lower travel structure 2. The lower travel structure 2 and the upper swing structure 3 are included in a machine body. A front-end portion of the upper swing structure 3 is provided with a front work implement 4 such that the front work implement 4 can move vertically to face upward and downward. The front work implement 4 is an articulated-type work device for performing excavation work and the like, and includes a boom 6, an arm 7 and a bucket 8, for example. The base-end side of the boom 6 is pivotably coupled with a front-end portion of the upper swing structure 3. A tip portion of the boom 6 is pivotably coupled with a base-end portion of the arm 7. A tip portion of the arm 7 is pivotably coupled with a base-end portion of the bucket 8. The boom 6, the arm 7 and the bucket 8 are driven by a boom cylinder 6*a*, an arm cylinder 7*a* and a bucket cylinder 8*a* as a hydraulic actuator, respectively.

The upper swing structure 3 includes: a swing frame 11 that is a support structure mounted swingably on the lower travel structure 2; a cab 12 installed on the front left side on the swing frame 11; a counterweight 13 provided at a rear end portion (a right end portion in FIG. 1) of the swing frame 11; and a machine room 14 arranged between the cab 12 and the counterweight 13. Operation devices that give instructions on the operation of the lower travel structure 2, the front work implement 4 and the like, an operator's seat on which an operator sits, and the like (all of which are not illustrated) are arranged in the cab 12. The counterweight 13 is for counterbalancing the weight of the front work implement 4.

As illustrated in FIG. 2, for example, the machine room 14 houses a large number of units of equipment including an engine 20 as a prime mover, a hydraulic pump (not illustrated) driven by the engine 20, and a cooling device 30 that cools the engine 20 and the like. The enclosure of the machine room 14 is formed by a housing cover 16. The housing cover 16 has suction ports (not illustrated) and discharge ports (not illustrated) provided therethrough to take in external air into the machine room 14, and discharge air from the inside of the machine room 14, respectively.

The cooling device 30 includes: a centrifugal fan 31 that generates cooling air; a bell mouth 32 that is arranged on the suction side of the centrifugal fan 31, rectifies air and guides the air to the centrifugal fan 31; and a heat exchanging device 33 that is cooled by the cooling air generated by the centrifugal fan 31. The centrifugal fan 31 is attached to a rotation shaft 23. The rotation shaft 23 is rotatably supported, above a drive shaft 20*a* of the engine 20, by the engine 20. The drive shaft 20*a* of the engine 20, and the rotation shaft 23 are provided with a first pulley 24 and a second pulley 25, respectively. A belt 26 is looped around the first pulley 24 and the second pulley 25. With such a configuration, the centrifugal fan 31 is rotation-driven by the engine 20 around a rotation axis A.

The bell mouth 32 has a shape whose flow-path cross-section becomes smaller toward the centrifugal fan 31. An end portion of the bell mouth 32 on the upstream side (the left side in FIG. 2) is attached to equipment in the machine room 14 or the housing cover 16, for example. An opening at an end portion of the bell mouth 32 on the side of the centrifugal fan 31 (the right side in FIG. 2) forms an outlet 32*a* for a flow of air. The outlet 32*a* of the bell mouth 32 is arranged on the radially inner side of a suction port 31*a* of the centrifugal fan 31 with a clearance D disposed therebetween.

The heat exchanging device 33 is arranged on the upstream side (the left side in FIG. 2) of the bell mouth 32, for example. The heat exchanging device 33 includes heat exchangers such as a radiator or an oil cooler. The radiator cools coolant of the engine 20, and the oil cooler cools hydraulic operating fluid supplied to the hydraulic actuators including the hydraulic cylinders 6*a*, 7*a* and 8*a* (see FIG. 1) of the front work implement 4.

In addition, a rectifying member 35 is arranged across the centrifugal fan 31 from the bell mouth 32. That is, the rectifying member 35 is arranged on the back side of a hub 41 mentioned below, which is the side opposite to the suction port 31*a* in the centrifugal fan 31. The rectifying member 35 is a member that suppresses a sudden expansion of airflow Fd discharged from the centrifugal fan 31 inside the machine room 14, and extends radially outward at least from the outer periphery of the centrifugal fan 31. The rectifying member 35 is an annular flat plate member whose outer periphery has a circular shape, an oval shape, a polygonal shape, or the like, and is fixed to the engine 20 via a stay 36. The rectifying member 35 also defines, together with the bell mouth 32, an air guide path for the airflow Fd discharged from the centrifugal fan 31. The rectifying member 35 can convert, by decelerating a tangential velocity component due to friction with the airflow Fd discharged from the centrifugal fan 31, part of the kinetic energy of the airflow Fd into a static pressure, and reduce the energy loss, although there is a loss caused by the friction.

Figure 3:
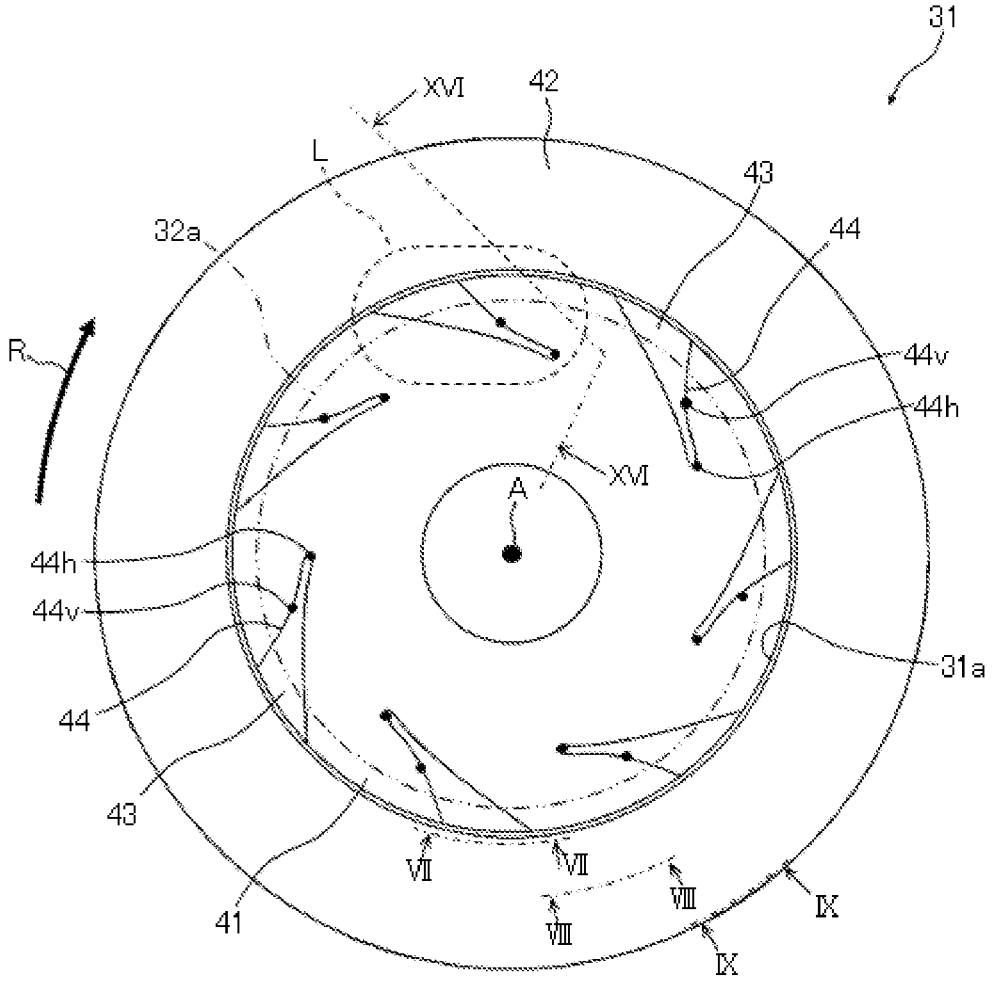
FIG. 3 is a figure illustrating the suction side of a centrifugal fan included as part of the construction machine according to the first embodiment of the present invention as seen in the axis direction.
Figure 4:
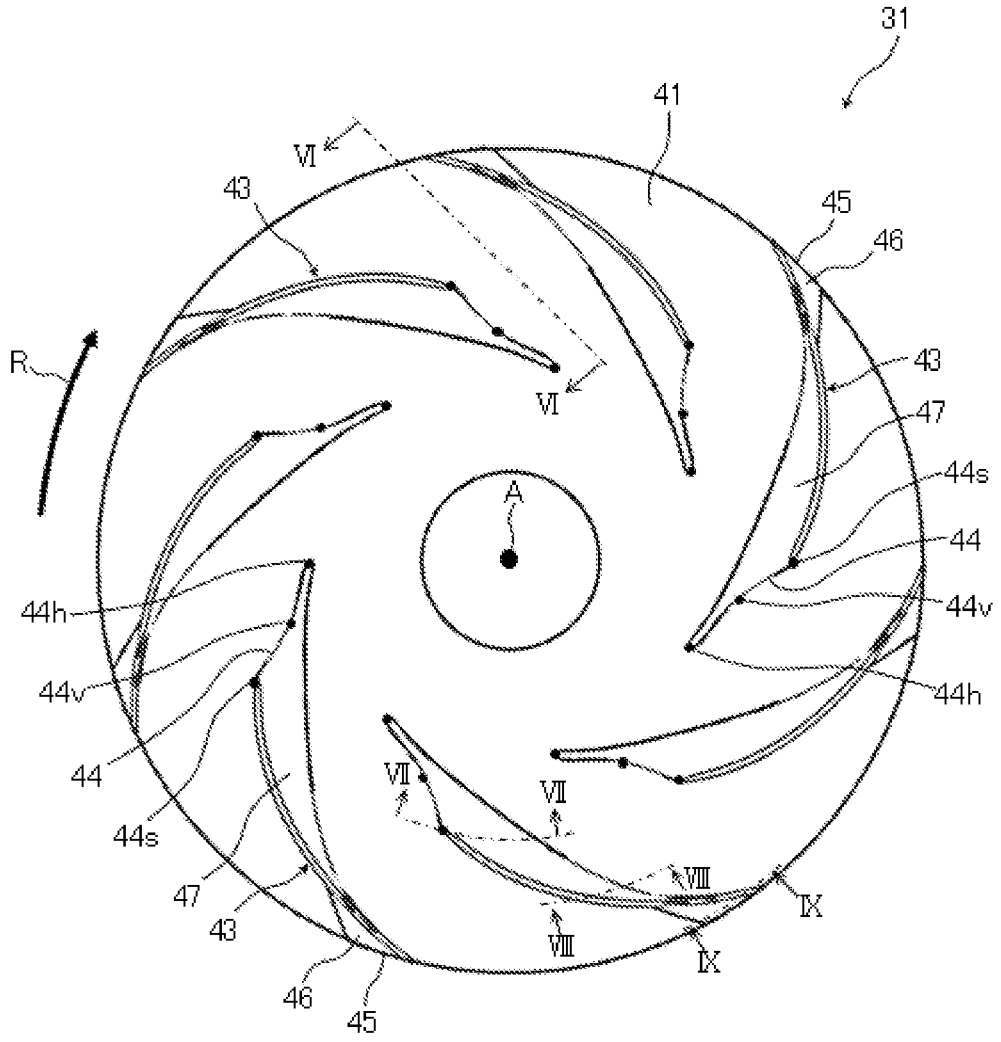
FIG. 4 is a figure illustrating the centrifugal fan illustrated in FIG. 3 in a state in which a shroud is removed.

Next, the configuration of the centrifugal fan in the construction machine according to the first embodiment of the present invention is explained by using drawings. First, the overall configuration of the centrifugal fan is explained by using FIG. 2 to FIG. 4. FIG. 3 is a figure illustrating the suction side of the centrifugal fan included as part of the construction machine according to the first embodiment of the present invention as seen in the axis direction. FIG. 4 is a figure illustrating the centrifugal fan illustrated in FIG. 3 in a state in which a shroud is removed.

In FIG. 2 to FIG. 4, the centrifugal fan 31 includes: the disc-like hub 41 that is attached to the rotation shaft 23, and is rotatable around the rotation axis A; an annular shroud 42 that is arranged coaxially with the hub 41 such that the shroud 42 faces one axial side (the left side in FIG. 2) of the hub 41, and forms a flow path between the shroud 42 and the hub 41; and a plurality of blades 43 that are provided between the hub 41 and the shroud 42 at predetermined intervals from each other in the circumferential direction. As illustrated in FIG. 2 and FIG. 3, the shroud 42 is formed such that its diameter is smaller on one axial side (the left side in FIG. 2) than on the other side (the right side in FIG. 2). An opening of the shroud 42 with the smaller diameter positioned at a central portion on the one axial side forms the suction port 31*a* of the centrifugal fan 31.

Figure 5:
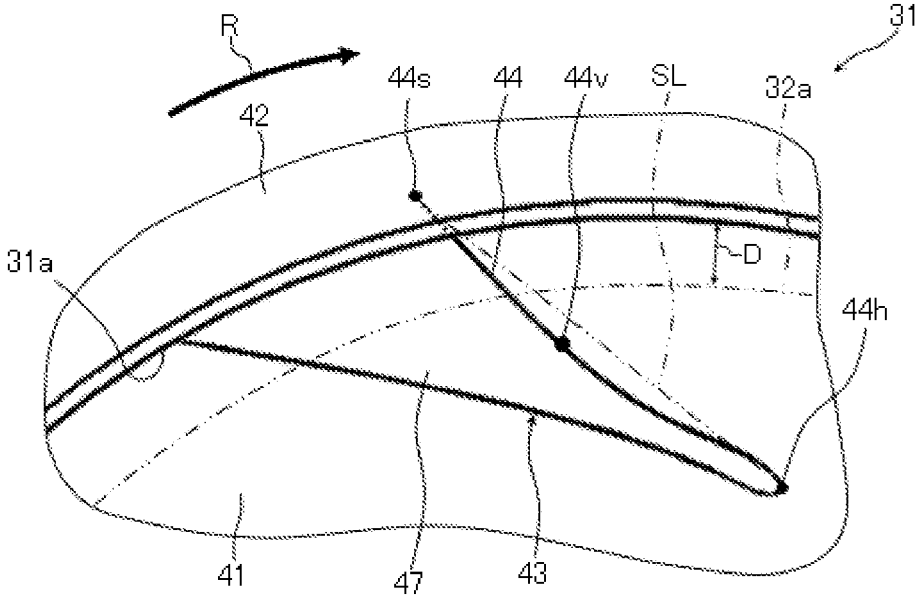
FIG. 5 is an enlarged view of a region indicated by a reference character L in FIG. 3, and is a figure illustrating the vicinity of the leading edge and leading edge of a blade of the centrifugal fan.
Figure 6:
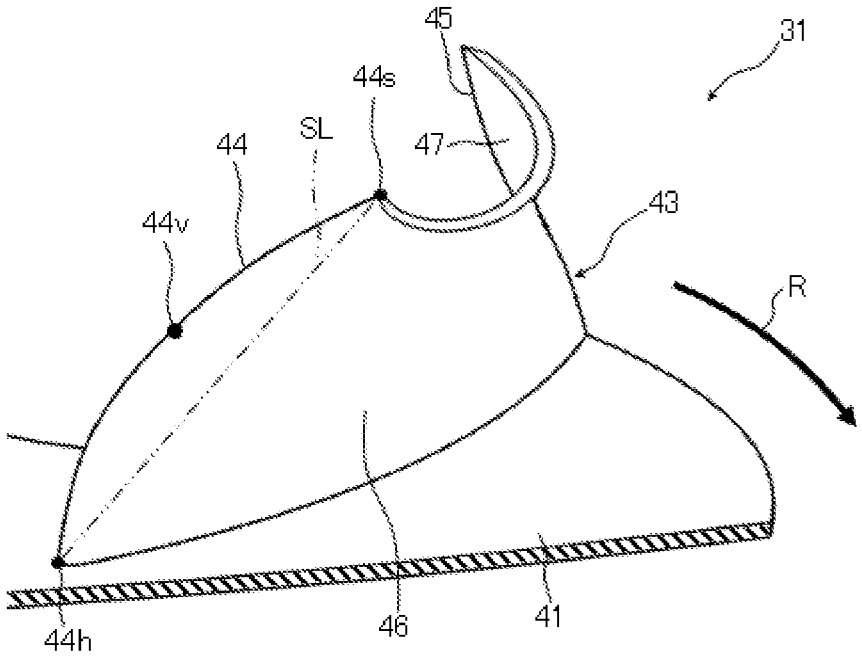
FIG. 6 is a perspective view of the centrifugal fan illustrated in FIG. 4 as seen in the direction of arrows VI-VI, and is a figure illustrating a blade shape of the centrifugal fan.
Figure 7:
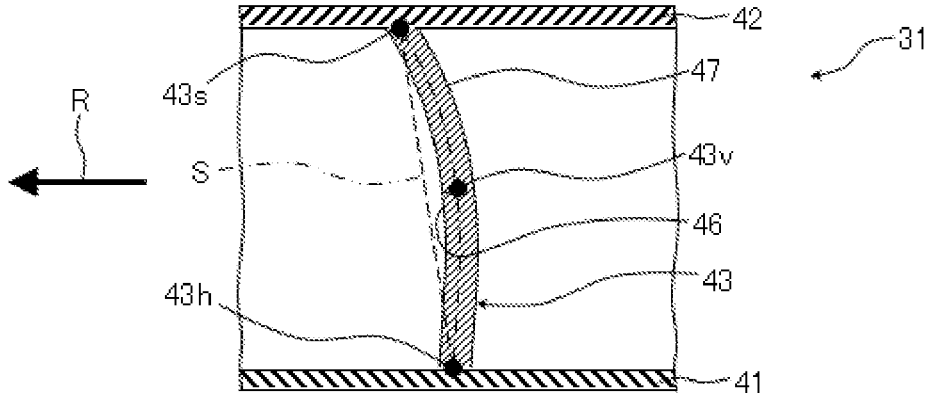
FIG. 7 is a cross-sectional view of the centrifugal fan illustrated in FIG. 3 taken along arrows VII-VII (a cross-sectional view taken along a cylindrical plane centered on the rotation axis at the position of a connection of the leading edge of a blade with the shroud).
Figure 8:
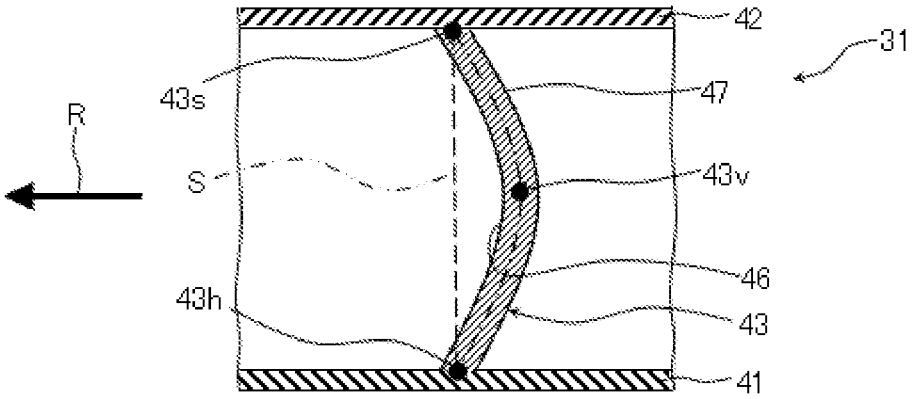
FIG. 8 is a cross-sectional view of the centrifugal fan illustrated in FIG. 3 taken along arrows VIII-VIII (a cross-sectional view taken along a cylindrical plane centered on the rotation axis at a position near the middle of the blade in the chord direction).
Figure 9:
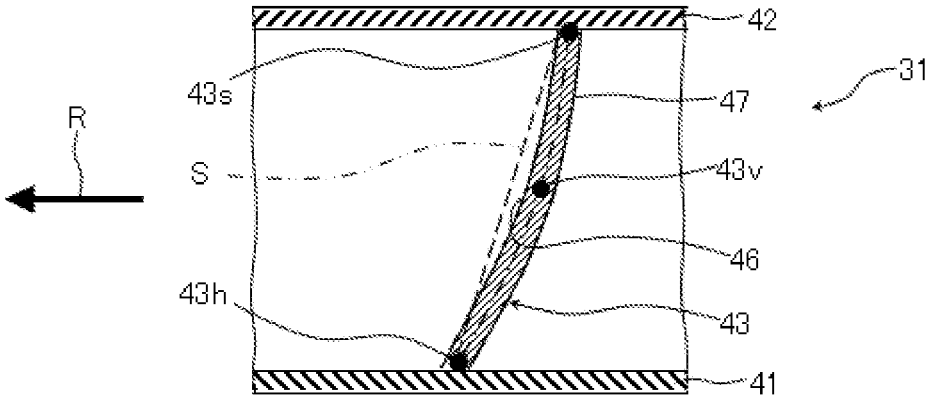
FIG. 9 is a cross-sectional view of the centrifugal fan illustrated in FIG. 3 taken along arrows IX-IX (a cross-sectional view taken along a cylindrical plane centered on the rotation axis at a position near the trailing edge of the blade).

Next, the shape of each blade of the centrifugal fan is explained by using FIG. 2 to FIG. 9. FIG. 5 is an enlarged view of a region indicated by a reference character L in FIG. 3, and is a figure illustrating the vicinity of the leading edge and leading edge of a blade of the centrifugal fan. FIG. 6 is a perspective view of the centrifugal fan illustrated in FIG. 4 as seen in the direction of arrows VI-VI, and is a figure illustrating a blade shape of the centrifugal fan. FIG. 7 is a cross-sectional view of the centrifugal fan illustrated in FIG. 3 taken along arrows VII-VII (a cross-sectional view taken along a cylindrical plane centered on the rotation axis at the position of a connection of the leading edge of a blade with the shroud). FIG. 8 is a cross-sectional view of the centrifugal fan illustrated in FIG. 3 taken along arrows VIII-VIII (a cross-sectional view taken along a cylindrical plane centered on the rotation axis at a position near the middle of the blade in the chord direction). FIG. 9 is a cross-sectional view of the centrifugal fan illustrated in FIG. 3 taken along arrows IX-IX (a cross-sectional view taken along a cylindrical plane centered on the rotation axis at a position near the trailing edge of the blade).

As illustrated in FIG. 2 and FIG. 4, each blade 43 includes: a leading edge 44 on the side where air flows in; a trailing edge 45 on the side where air flows out; a pressure surface 46 that is one of blade surfaces extending between the leading edge 44 and the trailing edge 45, and faces forward relative to a rotation direction R; and a suction surface 47 that is the other of the blade surfaces (the back side of the pressure surface 46) extending between the leading edge 44 and the trailing edge 45, and faces backward relative to the rotation direction R. The direction of the blade 43 extending from a connection with the hub 41 to a connection with the shroud 42 is defined as the span direction of the blade 43. In addition, the direction of the blade 43 extending from the leading edge 44 to the trailing edge 45 is defined as the chord direction of the blade 43.

As illustrated in FIG. 3 to FIG. 5, at the leading edge 44 of each blade 43, a connection 44*h* with the hub 41 is positioned on the radially inner side of a connection 44*s* with the shroud 42. In addition, as illustrated in FIG. 5 and FIG. 6, the leading edge 44 is curved such that it has a convex shape protruding toward the suction surface 47 (backward relative to the rotation direction R) relative to a line segment SL linking the connection 44*h* with the hub 41 and the connection 44*s* with the shroud 42. Furthermore, as illustrated in FIG. 3 and FIG. 5, each blade 43 is formed such that, when the suction side of the centrifugal fan 31 is seen in the axis direction of the centrifugal fan 31, a vertex 44*v* of the convex shape of the leading edge 44 is positioned on a radially inner side (on the side of the rotation axis A) relative to the wall surface of the outlet 32*a* of the bell mouth 32.

As illustrated in FIG. 4 and FIG. 6, each blade 43 is formed such that the convex shape at the leading edge 44 that is curved toward the suction surface 47 extends in the chord direction, and reaches the trailing edge 45. That is, as illustrated in FIG. 7 to FIG. 9, the blade 43 is curved such that each cross-section from the leading edge 44 to the trailing edge 45 that is taken along a cylindrical plane centered on the rotation axis A has a convex shape protruding toward the suction surface 47 (backward relative to the rotation direction R) relative to a line segment S linking a connection (base) 43*h* of the blade 43 with the hub 41 and a connection (tip) 43*s* of the blade 43 with the shroud 42.

As illustrated in FIG. 7 and FIG. 8, the blade 43 is formed such that the curvature at a vertex 43*v* of the convex shape described above gradually increases from the leading edge 44 toward a position near the middle in the chord direction (a middle position between the leading edge 44 and the trailing edge 45). Additionally, as illustrated in FIG. 8 and FIG. 9, the blade 43 is formed such that the curvature at the vertex 43*v* of the convex shape described above gradually decreases from the position near the middle in the chord direction (the middle position between the leading edge 44 and the trailing edge 45) toward the trailing edge 45. That is, the blade 43 includes: a first curved blade section which is positioned on the side of the leading edge 44, and in which the curvature at the vertex 43*v* of the convex shape of the blade 43 gradually increases from the leading edge 44; and a second curved blade section which is positioned on the side of the trailing edge 45, and in which the curvature at the vertex 43*v* of the convex shape of the blade 43 gradually decreases toward the trailing edge 45.

In addition, as illustrated in FIG. 7 to FIG. 9, the blade 43 is formed such that the circumferential relative positions of the connections 43*s* with the shroud 42 relative to the connections 43*h* with the hub 41 on blade cross-sections that are taken along cylindrical planes centered on the rotation axis A are displaced backward relative to the rotation direction R gradually from the leading edge 44 toward the trailing edge 45. More specifically, as illustrated in FIG. 7, in a blade cross-section near the leading edge 44 of the blade 43, the circumferential position of the connection 43*s* with the shroud 42 is displaced forward relative to the rotation direction R as compared to the circumferential position of the connection 43*h* with the hub 41. As illustrated in FIG. 8, in a blade cross-section at a position near the middle of the blade 43 in the chord direction, the circumferential position of the connection 43*s* with the shroud 42 is approximately the same as the circumferential position of the connection 43*h* with the hub 41. As illustrated in FIG. 9, in a blade cross-section near the trailing edge 45 of the blade 43, the circumferential position of the connection 43*s* with the shroud 42 is displaced backward relative to the rotation direction R as compared to the circumferential position of the connection 43*h* with the hub 41. In this manner, from the vicinity of the leading edge 44 to the position near the middle in the chord direction, the circumferential relative position of the connection 43*s* with the shroud 42 relative to the connection 43*h* with the hub 41 is displaced forward relative to the rotation direction R. On the other hand, from the position near the middle in the chord direction to the trailing edge 45, the circumferential relative position of the connection 43*s* with the shroud 42 relative to the connection 43*h* with the hub 41 is displaced backward relative to the rotation direction R.

Figure 10:
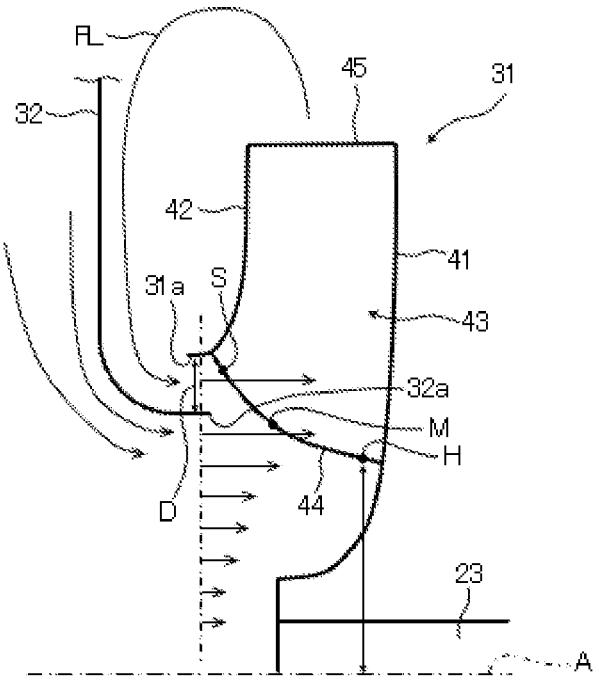
FIG. 10 is an explanatory diagram illustrating the flow velocity distribution in the radial direction of airflow passing through a centrifugal fan suction port in the construction machine according to the first embodiment of the present invention.
Figure 11:
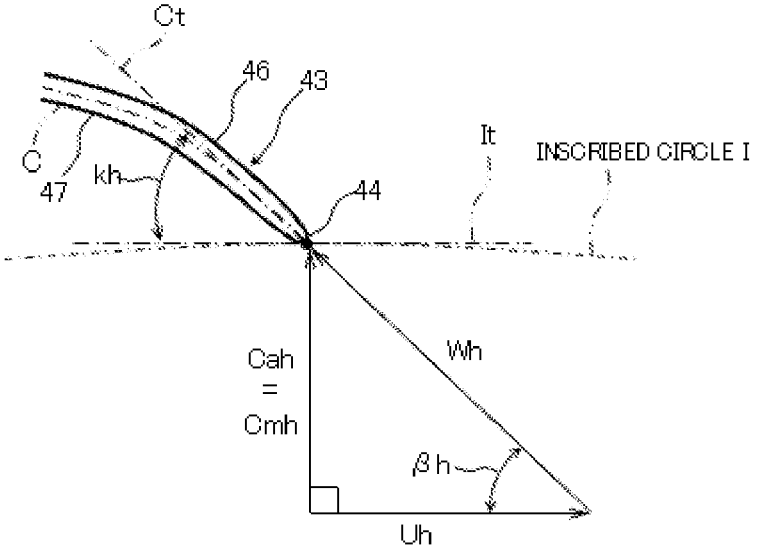
FIG. 11 is an explanatory diagram illustrating a velocity triangle at a position (a position H illustrated in FIG. 10) that is on a blade leading edge of the centrifugal fan, and closer to a hub in the construction machine according to the first embodiment of the present invention.
Figure 12:
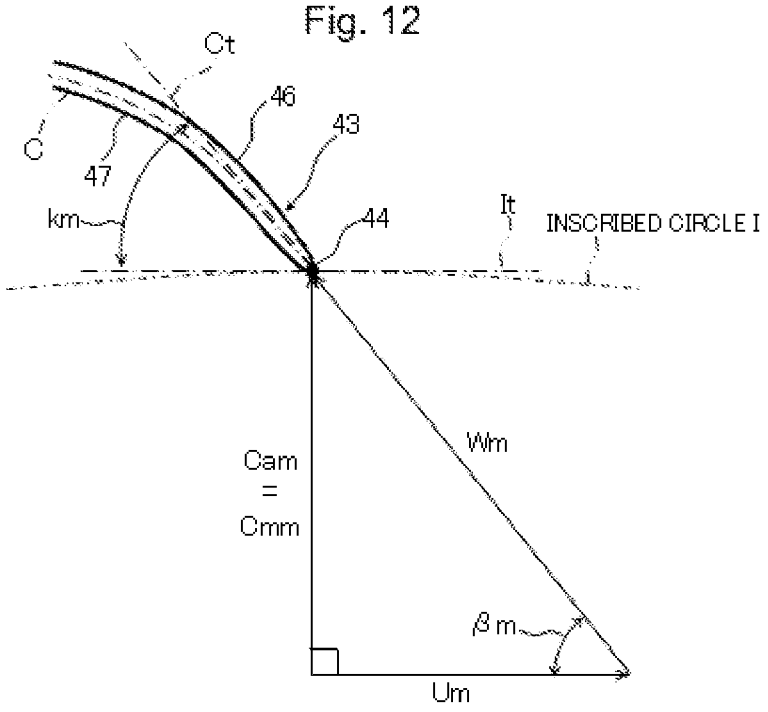
FIG. 12 is an explanatory diagram illustrating a velocity triangle at a position (a position M illustrated in FIG. 10) near the middle, in the span direction, of the blade leading edge of the centrifugal fan in the construction machine according to the first embodiment of the present invention.
Figure 13:
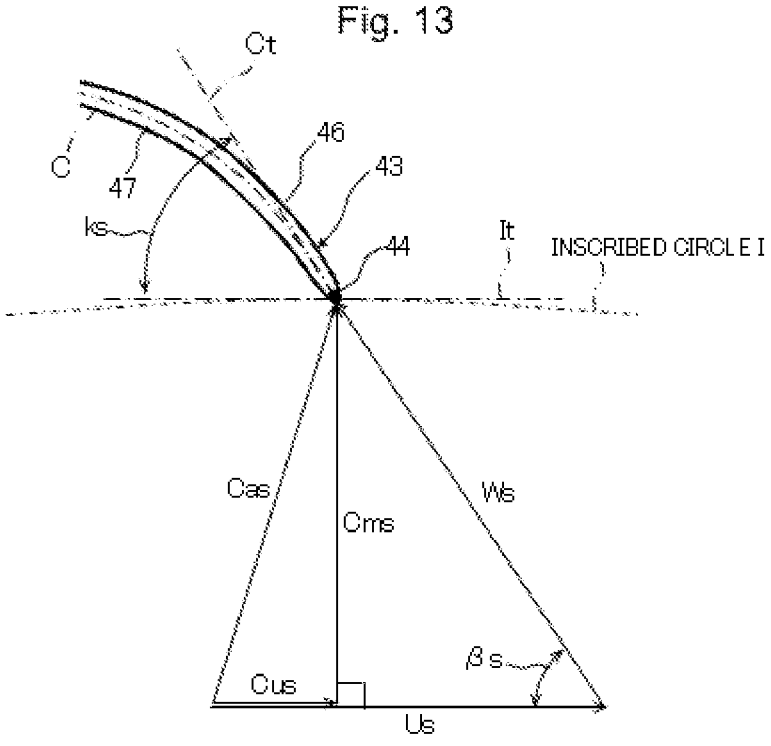
FIG. 13 is an explanatory diagram illustrating a velocity triangle at a position (a position S illustrated in FIG. 10) that is on the blade leading edge of the centrifugal fan, and closer to the shroud in the construction machine according to the first embodiment of the present invention.

Next, it is explained how the inlet angle of the blades in the centrifugal fan is set, by using FIG. 10 to FIG. 13. FIG. 10 is an explanatory diagram illustrating the flow velocity distribution in the radial direction of airflow passing through a centrifugal fan suction port in the construction machine according to the first embodiment of the present invention. FIG. 11 is an explanatory diagram illustrating a velocity triangle at a position (a position H illustrated in FIG. 10) that is on a blade leading edge of the centrifugal fan, and closer to the hub in the construction machine according to the first embodiment of the present invention. FIG. 12 is an explanatory diagram illustrating a velocity triangle at a position (a position M illustrated in FIG. 10) near the middle, in the span direction, of the blade leading edge of the centrifugal fan in the construction machine according to the first embodiment of the present invention. FIG. 13 is an explanatory diagram illustrating a velocity triangle at a position (a position S illustrated in FIG. 10) that is on the blade leading edge of the centrifugal fan, and closer to the shroud in the construction machine according to the first embodiment of the present invention.

As illustrated in FIG. 10, in the present embodiment, the bell mouth 32 is installed on the suction side of the centrifugal fan 31, and the clearance D is provided between the suction port 31*a* of the centrifugal fan 31, and the outlet 32*a* of the bell mouth 32. In this case, part of air discharged from the centrifugal fan 31 passes through the clearance D between the centrifugal fan and the bell mouth, and flows in again as a leakage flow FL into the centrifugal fan. In addition, since the bell mouth 32 has a diameter that becomes smaller toward the outlet 32*a*, the speed of air flowing out from the outlet 32*a* of the bell mouth 32 becomes higher on the wall-surface side (the radially outer side) of the bell mouth 32 than on the center side (the radially inner side) of the bell mouth 32 (see the flow velocity distribution illustrated in FIG. 10). That is, the speed increases locally in a region near the wall surface of the outlet 32*a* of the bell mouth 32. Due to the influence of the bell mouth 32, a flow flowing into the suction port 31*a* of the centrifugal fan 31 has a higher speed in the vicinity of the wall surface of the shroud 42 than in a central section of the shroud 42.

In the present embodiment, the inlet angles of the blades 43 of the centrifugal fan 31 are set taking the influence of the bell mouth 32 described above into consideration. Each blade 43 is formed such that its inlet angle matches the inflow angle of air relative to the blade 43. In this case, since a flow of air flowing into the centrifugal fan 31 does not collide satisfies a collisionless flow condition, the collision loss of the flow can be reduced. Note that the inlet angle of a blade 43 means an angle formed between a tangent line Ct, at the leading edge 44, of a camber line C of a cross-sectional shape of the blade 43 illustrated in FIG. 11, and a tangent line It, at the leading edge 44, of an imaginary inscribed circle I that touches the leading edge 44 of the blade 43, and has its center at the rotation axis A of the centrifugal fan 31 (see FIG. 10). The camber line is a curve obtained by linking middle points between the pressure surface 46 and the suction surface 47 of the blade 43 one after another. The inflow angle is an angle formed between the relative inflow velocity vector of airflow, and the rotation direction R of the centrifugal fan 31.

Specifically, as illustrated in FIG. 11, at the position H (see FIG. 10) on the leading edge 44 of the blade 43 on the side of the hub 41, airflow flows in at a relative inflow velocity Wh determined from a circumferential speed Uh of the blade 43 and an absolute speed Cah of the airflow. The circumferential speed Uh is determined from the rated revolution speed of the centrifugal fan 31 and the radial distance from the rotation axis A to the position H (see the two-way arrow illustrated in FIG. 10). A meridian-plane-direction velocity Cmh is equal to the absolute speed Cah because it is supposed that there are no preswirls of airflow flowing into the suction port 31*a* of the centrifugal fan 31 from the inside of the bell mouth 32. Accordingly, an inlet angle kh of the blade 43 at the position H is set such that it matches an inflow angle βh obtained from the relative inflow velocity Wh determined from the circumferential speed Uh and the meridian-plane-direction velocity Cmh.

As illustrated in FIG. 12, at the position M (see FIG. 10) near the middle of the leading edge 44 of the blade 43 in the span direction, airflow flows in at a relative inflow velocity Wm determined from a circumferential speed Um of the blade 43 and an absolute speed Cam of the airflow. The circumferential speed Um is determined from the rated revolution speed of the centrifugal fan 31 and the radial distance from the rotation axis A to the position M. The circumferential speed Um at the position M is higher than the circumferential speed Uh at the position H because the position M is positioned on the radially outer side of the position H (see FIG. 10). A meridional plane velocity Cmm is higher than the meridional plane velocity Cmh (see FIG. 11) at the position H due to the influence of acceleration on the wall surface of the bell mouth 32 (see the flow velocity distribution illustrated in FIG. 10). The meridian-plane-direction velocity Cmm is equal to the absolute speed Cam because there are no preswirls similarly to the case of the position H. Accordingly, a blade inlet angle km at the position M is set such that it matches an inflow angle βm obtained from the relative inflow velocity Wm determined from the circumferential speed Um and the meridian-plane-direction velocity Cmm.

As illustrated in FIG. 10, at the position S on the leading edge 44 of the blade 43 on the side of the shroud 42, the leakage flow FL flows from the clearance D between the bell mouth 32 and the shroud 42 into the suction port 31*a* of the centrifugal fan 31. This leakage flow FL has a tangential velocity component because it is airflow discharged from the centrifugal fan 31. Accordingly, there is a preswirl in the flow of air flowing in at the position S. That is, as illustrated in FIG. 13, absolute speed Cas of airflow≠meridional plane velocity Cms, and the absolute speed Cas includes a tangential velocity Cus. Accordingly, at the position S (see in FIG. 10) on the leading edge 44 of the blade 43 on the side of the shroud 42, a flow flows in at a relative inflow velocity Ws determined from the absolute speed Cas including the tangential velocity Cus, and a circumferential speed Us of the blade 43. The circumferential speed Us is determined from the rated revolution speed of the centrifugal fan 31 and the radial distance from the rotation axis A to the position S. The circumferential speed Us at the position S is higher than the circumferential speed Um at the position M because the position S is positioned on the radially outer side of the position M (see FIG. 10). The absolute speed Cas is determined from the meridional plane velocity Cms and the tangential velocity Cus. The meridional plane velocity Cms is higher than the meridional plane velocity Cmh (see FIG. 11) at the position H due to the influence of acceleration at the wall surface of the bell mouth 32 (see the flow velocity distribution illustrated in FIG. 10). An inlet angle ks at the position S is set such that it matches an inflow angle βs obtained from an inflow relative speed Ws determined from the circumferential speed Us and the absolute speed Cas.

Figure 14:
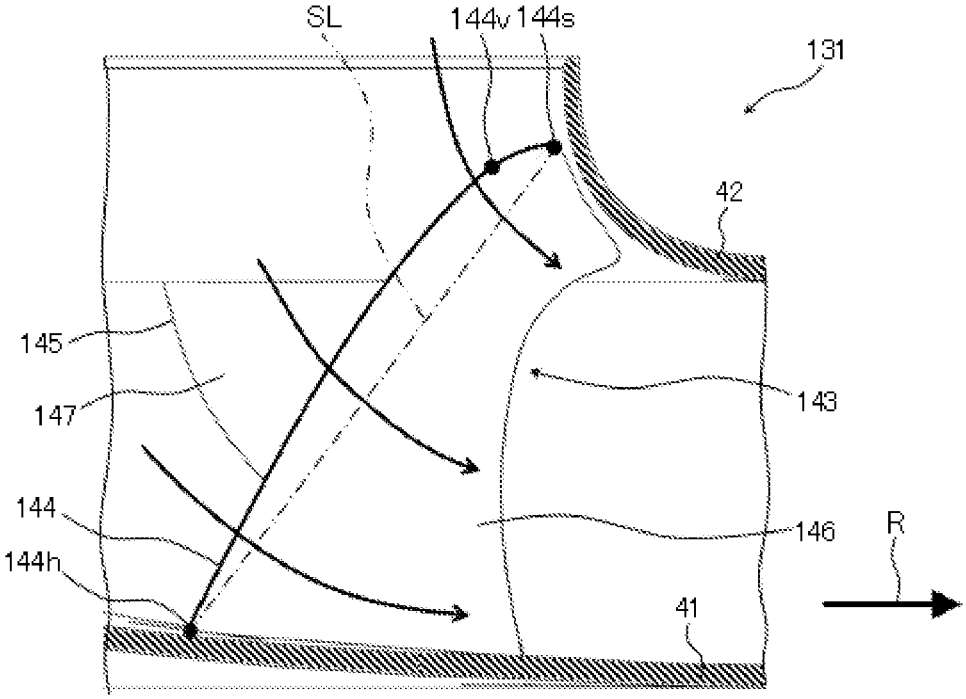
FIG. 14 is an explanatory diagram illustrating the structure of a conventional centrifugal fan, and a flow of air in the conventional centrifugal fan, and is a perspective view as seen in a direction similar to the direction of arrows XVI-XVI illustrated in FIG. 3.
Figure 15:
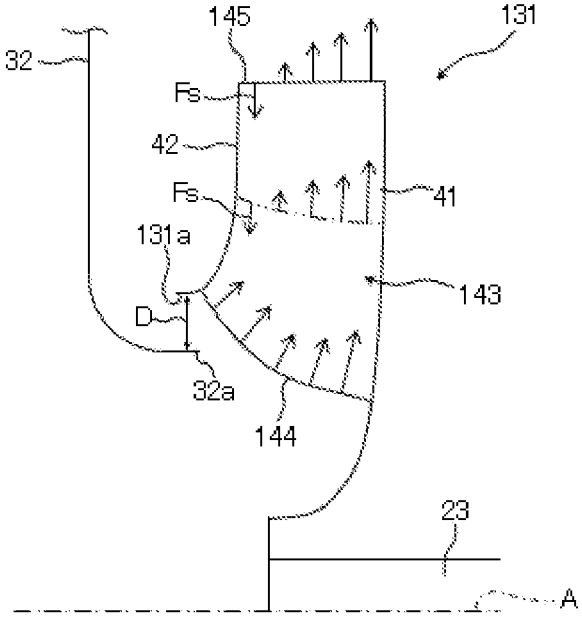
FIG. 15 is an explanatory diagram illustrating the flow velocity distribution in the span direction at the leading edge of a blade of the conventional centrifugal fan, near the middle of the blade in the chord direction, and at the trailing edge of the blade.

Next, a flow of air inside the centrifugal fan in the construction machine according to the first embodiment of the present invention, and advantages thereof are explained in comparison with a conventional centrifugal fan. First, the structure of the conventional centrifugal fan, and a flow of air inside the centrifugal fan are explained by using FIG. 10, FIG. 14 and FIG. 15. FIG. 14 is an explanatory diagram illustrating the structure of the conventional centrifugal fan, and a flow of air in the conventional centrifugal fan, and is a perspective view as seen in a direction similar to the direction of arrows XVI-XVI illustrated in FIG. 3. FIG. 15 is an explanatory diagram illustrating the flow velocity distribution in the span direction at the leading edge of a blade of the conventional centrifugal fan, near the middle of the blade in the chord direction, and at the trailing edge of the blade. In FIG. 14, thick arrows represent flows of air. In FIG. 15, the flow velocity distribution is represented by a plurality of arrows. Note that in FIG. 14 and FIG. 15, those having reference characters which are the same reference characters as those illustrated in FIG. 1 to FIG. 14 are similar sections, and thus detailed explanations thereof are omitted.

As illustrated in FIG. 14, in a conventional centrifugal fan 131, an end portion of a blade 143 on the side of the shroud 42 in the span direction is curved backward relative to the rotation direction R. That is, a leading edge 144 of the blade 143 is curved such that it has a convex shape protruding toward a suction surface 147 (backward relative to the rotation direction R) relative to a line segment SL linking a connection 144*h* with the hub 41, and a connection 144*s* with the shroud 42. The blade 143 is formed such that the position of a vertex 144*v* of the convex shape of the leading edge 144 is near the shroud 42.

Since the centrifugal fan 131 suctions air from the axis direction (the upward direction in FIG. 14), and discharges the air radially outward, the flow of the air inside the fan is caused to turn suddenly. The airflow is pressed toward the hub 41 due to an inertial force when the airflow having been flowing in the axis direction is caused to turn radially outward. In addition, airflow on the side of the shroud 42 needs to be turned at a curvature larger than the curvature of the airflow on the side of the hub 41, but the airflow on the side of the shroud 42 does not sufficiently follow the wall-surface shape of the shroud 42 and is pressed toward the hub 41.

Since, in the blade 143 of the conventional centrifugal fan 131 described above, the blade 143 is curved such that it has a convex shape protruding toward the suction surface 147, the influence of the pressing of the airflow toward the hub 41 is mitigated because of the shape of the blade surface of the blade 143. However, since the position of the vertex 144*v* in the convex shape of the blade 143 is near the shroud 42, the influence of the pressing of only the airflow near the shroud 42 toward the hub 41 is mitigated. Accordingly, the influence of the pressing of the airflow toward the hub 41 cannot be mitigated sufficiently, and this creates a non-uniform flow velocity distribution, in the span direction of the blade 143, in which the flow velocity on the side of the hub 41 becomes higher than the flow velocity on the side of the shroud 42, at a radial position where the direction of the airflow has been turned in the radial direction to some extent.

Specifically, a flow velocity distribution like the following one is created. As illustrated in FIG. 15, in the conventional centrifugal fan 131, the bell mouth 32 is arranged on the suction side similarly to the present embodiment. In the flow velocity distribution on a meridional plane cross-section of the outlet 32*a* of the bell mouth 32, the flow velocity near the wall surface of the bell mouth 32 is higher than the flow velocity on the center side (on the side of the rotation axis A) (see the flow velocity distribution illustrated in FIG. 10). Accordingly, at a suction port 131*a* of the conventional centrifugal fan 131 also, there is a flow velocity distribution in which the flow rate on the side of the shroud 42 is higher than the flow rate on the side of the hub 41.

As illustrated in FIG. 15, at the leading edge 144 of the conventional blade 143, airflow is pressed toward the hub 41, and this creates a flow velocity distribution in which the speed difference between the side of the shroud 42 and the side of the hub 41 is reduced. That is, the flow velocity distribution in the span direction at the leading edge 144 is made more uniform than the flow velocity distribution in the radial direction at the suction port 131*a*.

On the other hand, in the first half of the flow path from the leading edge 144 to the vicinity of the middle in the chord direction, the pressing of airflow toward the hub 41 due to a radially outward turn of the airflow having been flowing in the axis direction continues. Accordingly, at a position (the position indicated by a two-dot chain line in FIG. 15) near the middle, there is a flow velocity distribution in the span direction in which the flow velocity becomes gradually lower from the side of the hub 41 toward the shroud 42. When there is a flow velocity distribution in which the speed difference between the side of the hub 41 and the side of the shroud 42 changes suddenly, the airflow cannot flow sufficiently along the shroud 42, and turns into a flow Fs separated from the shroud 42.

In addition, since the turn of the airflow has ended in the second half of the flow path from the vicinity of the middle in the chord direction to a trailing edge 145, the airflow is not pressed toward the hub 41. Accordingly, at the trailing edge 145 of the blade 143, there is a flow velocity distribution almost the same as the flow velocity distribution in the span direction near the middle in the chord direction. That is, there is a flow velocity distribution in the span direction at the trailing edge 145 in which the flow velocity becomes gradually lower from the side of the hub 41 toward the shroud 42.

In this manner, in the conventional centrifugal fan 131, the speed difference between the side of the hub 41 and the side of the shroud 42 cannot be reduced effectively. That is, it is difficult to improve the fan characteristics of non-uniform flow rates which are higher on the side of the hub 41 at the trailing edge 145 of the blade 143.

Figure 16:
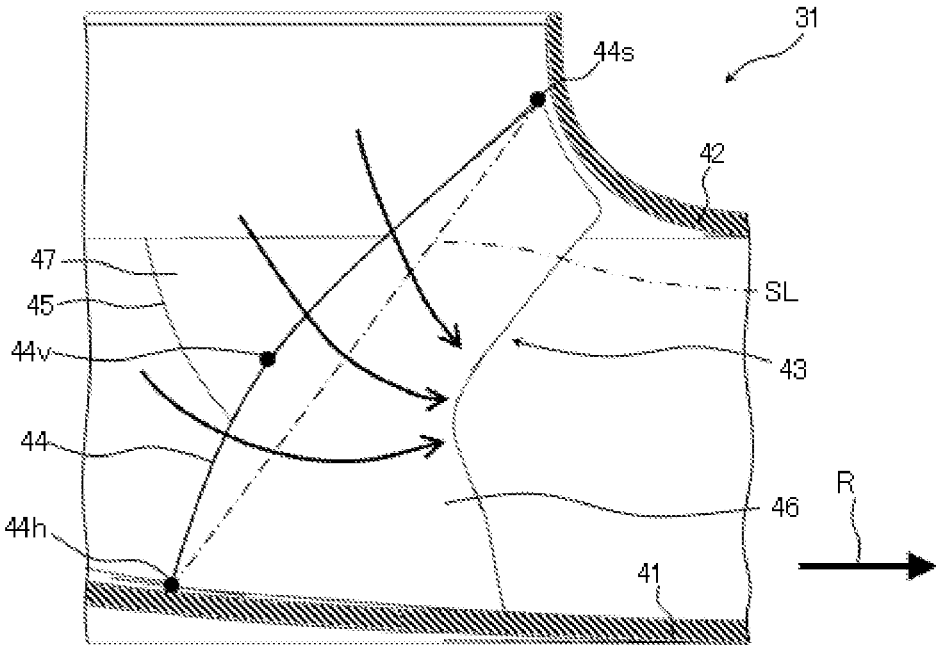
FIG. 16 is an explanatory diagram illustrating a flow from the leading edge of a blade to the vicinity of the middle of the blade in the chord direction in the centrifugal fan in the construction machine according to the first embodiment of the invention, and is a perspective view as seen in the arrows XVI-XVI illustrated in FIG. 3.
Figure 17:
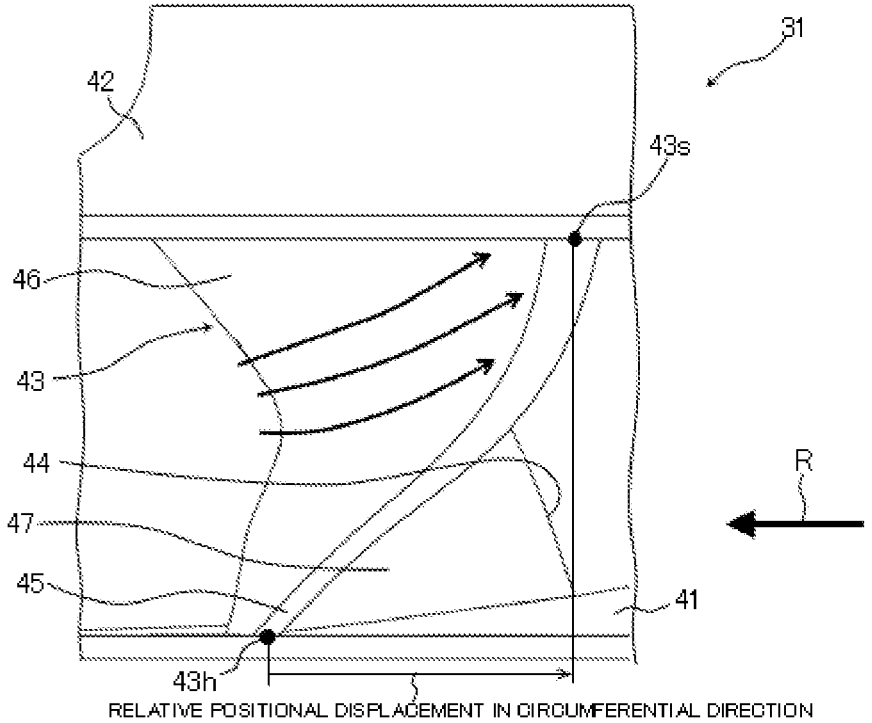
FIG. 17 is an explanatory diagram illustrating a flow of air from the vicinity of the middle of the blade in the chord direction to the trailing edge of the blade in the centrifugal fan in the construction machine according to the first embodiment of the invention.
Figure 18:
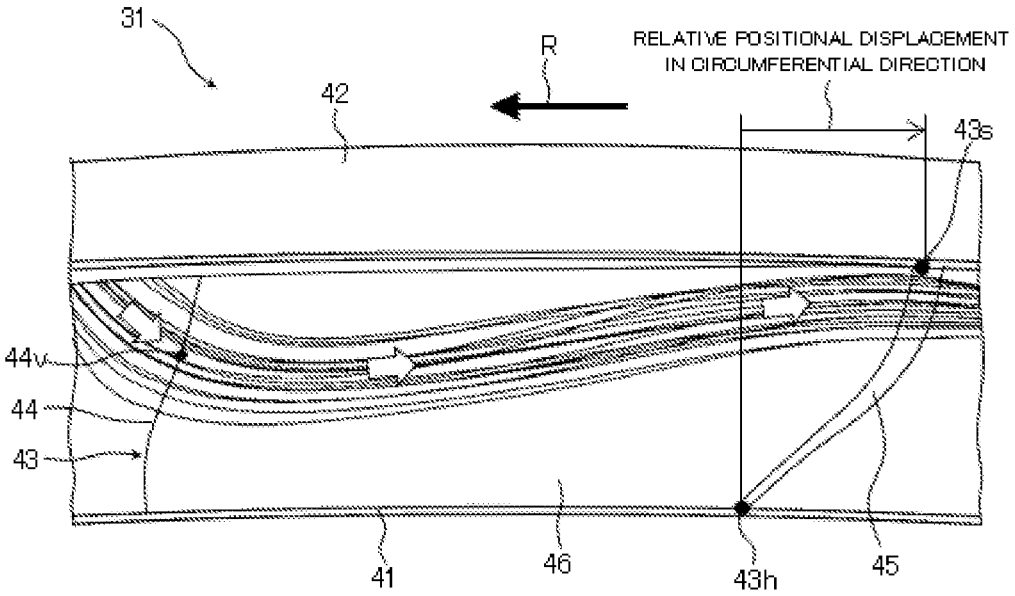
FIG. 18 is a figure illustrating a result of analysis of a flow field along a pressure surface of a blade of the centrifugal fan in the construction machine according to the first embodiment of the invention.
Figure 19:
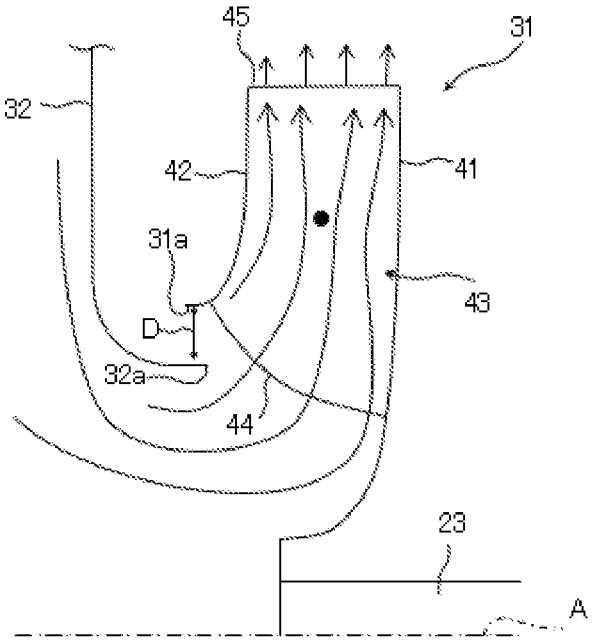
FIG. 19 is a figure illustrating a flow of air inside the centrifugal fan in the construction machine according to the first embodiment of the invention.

Next, a flow of air in the centrifugal fan in the construction machine according to the first embodiment of the present invention, and advantages thereof are explained by using FIG. 5, and FIG. 16 to FIG. 19. FIG. 16 is an explanatory diagram illustrating a flow from the leading edge of a blade to the vicinity of the middle of the blade in the chord direction in the centrifugal fan in the construction machine according to the first embodiment of the invention, and is a perspective view as seen in the arrows XVI-XVI illustrated in FIG. 3. FIG. 17 is an explanatory diagram illustrating a flow of air from the vicinity of the middle of the blade in the chord direction to the trailing edge of the blade in the centrifugal fan in the construction machine according to the first embodiment of the invention. FIG. 18 is a figure illustrating a result of analysis of a flow field along a pressure surface of a blade of the centrifugal fan in the construction machine according to the first embodiment of the invention. FIG. 19 is a figure illustrating a flow of air inside the centrifugal fan in the construction machine according to the first embodiment of the invention. In FIG. 16 and FIG. 17, thick arrows represent flows. In FIG. 18, outline arrows represent directions of flows. In FIG. 19, a black dot indicates a position where the curvature at the vertex of the curved convex shape of a blade is the maximum.

As illustrated in FIG. 5 and FIG. 16, in the present embodiment, the leading edge 44 of the blade 43 is curved such that it has the convex shape protruding toward the suction surface 47 (backward relative to the rotation direction R). Furthermore, each blade 43 is formed such that, when the suction side of the centrifugal fan 31 is seen in the axis direction of the centrifugal fan 31, the position of the vertex 44*v* of the convex shape of the leading edge 44 is on the radially inner side of the wall surface of the outlet 32*a* of the bell mouth 32. That is, the position of the vertex 44*v* of the convex shape of the leading edge 44 is displaced toward the hub 41 relative to the position of the vertex 144*v* of the convex shape of the leading edge 144 in the blade 143 of the conventional centrifugal fan 131 illustrated in FIG. 14. Because of this shape of the leading edge 44, it is possible to lower the flow rate of a flow moving toward the hub 41 due to a radially outward turn of the flow of air having flowed into the suction port 31*a* of the centrifugal fan 31 and having been flowing in the axis direction. In particular, as compared with the conventional centrifugal fan 131 (see FIG. 14), as illustrated in FIG. 16, it is possible to suppress the movement of the airflow near the middle in the span direction toward the hub 41, and it is possible to make part of airflow on the side of the hub 41 closer to the middle in the span direction.

Furthermore, as illustrated in FIG. 16, in the present embodiment, each blade 43 is formed such that the convex shape at the leading edge 44 extends in the chord direction, and the curvature at the vertex of the convex shape described above gradually increases from the leading edge 44 toward the position near the middle in the chord direction. As compared with the conventional centrifugal fan 131 (see FIG. 14), because of such a curved shape of the blade 43, it is possible to suppress the movement, toward the hub 41 due to a radially outward turn, of airflow on the side of the hub 41 having been flowing in the axis direction, and it is possible to gather airflow to the vicinity of the vertex of the convex shape near the middle in the chord direction.

Additionally, as illustrated in FIG. 17, in the present embodiment, each blade 43 is formed such that the convex shape at the leading edge 44 extends to the trailing edge 45 in the chord direction, and the curvature at the vertex of the convex shape described above gradually decreases from the position near the middle in the chord direction toward the trailing edge 45. Because of such a curved shape of the blade 43, it is possible to diffuse, in the span direction and on the side of the trailing edge 45, the airflow gathered to the vicinity of the vertex of the convex shape near the middle in the chord direction.

Furthermore, in addition, in the present embodiment, each blade 43 is formed such that: a circumferential relative position of the connection 43*s* with the shroud 42 relative to the connection 43*h* with the hub 41 on a cross-section of the blade 43 taken along a cylindrical plane centered on the rotation axis A is displaced gradually backward, relative to the rotation direction R, from the leading edge 44 toward the trailing edge 45 (see FIG. 7 to FIG. 9); and a circumferential position of the connection 43*s* with the shroud 42 at the trailing edge 45 is displaced backward, relative to the rotation direction R, from the circumferential position of the connection 43*h* with the hub 41 at the trailing edge 45 as illustrated in FIG. 17. Because of such a shape of the blade 43, it is possible to guide, toward the shroud 42, airflow that tends to gather on the side of the hub 41, and diffuse the airflow in the span direction at the trailing edge 45.

In this manner, in the present embodiment, by defining the curved shape of each blade 43 such that the curvature at the vertex of the convex shape protruding toward the suction surface 47 and extending from the leading edge 44 of the blade 43 to the trailing edge 45 gradually increases from the leading edge 44 toward the position near the middle in the chord direction and gradually decreases from the position near the middle in the chord direction toward the trailing edge 45, and by defining positions of the connecting of the blade 43 with the hub 41 and the shroud 42 such that the circumferential relative position of the connection 43*s* of the blade 43 with the shroud 42 relative to the connection 43*h* of the blade 43 with the hub 41 is displaced backward in the rotation direction R gradually from the leading edge 44 toward the trailing edge 45, and the connection 43*s* of the blade 43 at the trailing edge 45 with the shroud 42 is displaced backward in the rotation direction R relative to the connection 43*h* of the blade 43 at the trailing edge 45 with the hub 41, as illustrated in FIG. 18, air having flowed in from the vicinity of the vertex 44*v* of the convex shape of the leading edge 44 can be gathered on the side of the vertex 43*v* of the convex shape in a process of reaching the vicinity of the middle in the chord direction from the leading edge 44, and thereafter can be guided toward the shroud 42 in a process of heading toward the trailing edge 45. Thereby, as illustrated in FIG. 19, in the first half of the flow path of the centrifugal fan 31, the flow rate of airflow moving toward the hub 41 due to turning radially outward from the axis direction can be reduced, and airflow in the second half of the flow path can be diffused in the span direction. Accordingly, the flow velocity distribution in the span direction at the trailing edge 45 can be made uniform from the side of the hub 41 to the side of the shroud 42. That is, non-uniform fan characteristics (see FIG. 15) in which flow rates become higher on the side of the hub 41 at the discharge port of the conventional centrifugal fan 131 can be improved.

As mentioned above, according to the construction machine according to the first embodiment of the present invention, since the blades 43 of the centrifugal fan 31 are formed such that the vertex 44*v* of the convex shape protruding toward the suction surface 47 at the leading edge 44 of each blade 43 is positioned on the radially inner side of the wall surface of the outlet 32*a* of the bell mouth 32 when seen in the axis direction, it is possible to suppress the movement, toward the hub 41, of a flow of air having flowed from the vicinity of the wall surface of the bell mouth 32 into the centrifugal fan 31 caused by an inertial force at the time of a radially outward turn. As a result, in the centrifugal fan 31 mounted on the hydraulic excavator (construction machine) 1, it is possible to mitigate the flow velocity distribution in the span direction of the blade 43 that has a tendency that the speed of airflow on the side of the hub 41 becomes higher than the speed of airflow on the side of the shroud 42.

Figure 20:
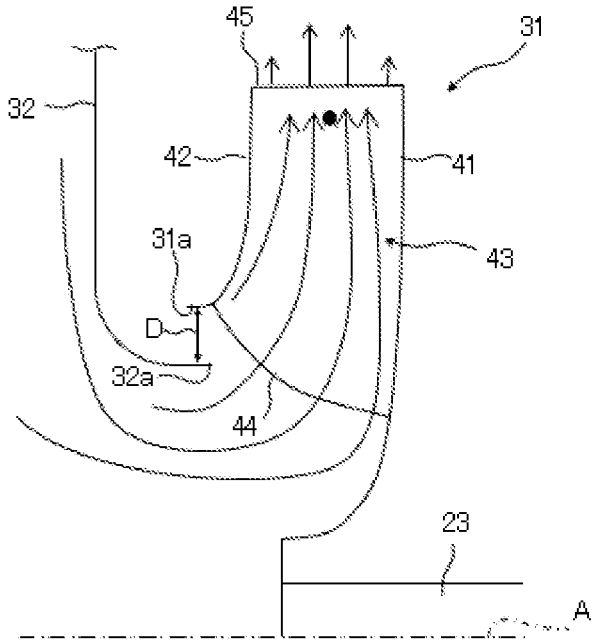
FIG. 20 is a figure illustrating a flow of air inside a centrifugal fan in a construction machine according to a first modification example of the first embodiment of the invention.
Figure 21:
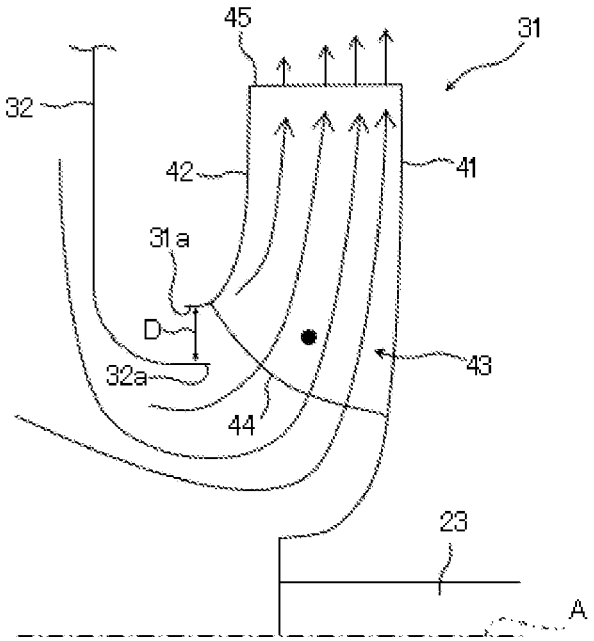
FIG. 21 is a figure illustrating a flow of air inside a centrifugal fan in a construction machine according to a second modification example of the first embodiment of the invention.

Next, construction machines according to a first modification example and a second modification example of the first embodiment of the present invention are explained by using FIG. 20 and FIG. 21. FIG. 20 is a figure illustrating a flow of air inside the centrifugal fan in the construction machine according to the first modification example of the first embodiment of the invention. FIG. 21 is a figure illustrating a flow of air inside the centrifugal fan in the construction machine according to the second modification example of the first embodiment of the invention. In FIG. 20 and FIG. 21, black dots indicate positions where the curvature at the vertex of the curved convex shape of a blade is the maximum. Note that in FIG. 20 and FIG. 21, those having reference characters which are the same reference characters as those illustrated in FIG. 1 to FIG. 19 are similar sections, and thus detailed explanations thereof are omitted.

The difference of the construction machine according to the first modification example of the first embodiment of the present invention illustrated in FIG. 20 from the first embodiment is that the position where the curvature at the vertex 43*v* of the curved convex shape of a blade 43 has the maximum curvature is not at a position near the middle in the chord direction (see FIG. 19) unlike the first embodiment, but near the trailing edge 45. Specifically, the blade 43 is formed such that the curvature at the vertex of the convex shape described above gradually increases from the leading edge 44 toward the vicinity (the position of the black dot) of the trailing edge 45. Additionally, the blade 43 is formed such that the curvature at the vertex of the convex shape described above gradually decreases from the vicinity (the position of the black dot) of the trailing edge 45 toward the trailing edge 45. That is, the blade 43 includes: the first curved blade section on the side of the leading edge 44, the first curved blade section being a section lying from the leading edge 44 to the vicinity (the position of the black dot) of the trailing edge 45, and the curvature at the vertex of the convex shape of the blade 43 gradually increases from the leading edge 44; and the second curved blade section on the side of the trailing edge 45, the second curved blade section being a section lying from the vicinity (the position of the black dot) of the trailing edge 45 to the trailing edge 45, and the curvature at the vertex of the convex shape of the blade 43 gradually decreases toward the trailing edge 45.

In the present modification example, air having flowed into the centrifugal fan 31 is gathered on the side of the vertex of the convex shape of the blade 43 in a process of reaching the vicinity (the position of the black dot) of the trailing edge 45 from the leading edge 44, and is guided toward the shroud 42 in a process of reaching the trailing edge 45. Thereby, the flow rate of airflow moving toward the hub 41 can be reduced, and airflow can be diffused in the span direction in the vicinity of the trailing edge 45. Accordingly, non-uniform fan characteristics (see FIG. 15) in which flow rates become higher on the side of the hub 41 at the discharge port of the conventional centrifugal fan 131 can be improved.

It should be noted however that, in the present modification example, the position of the maximum curvature at the vertex of the convex shape of the blade 43 is displaced toward the trailing edge 45 as compared with the first embodiment, and thus, by a corresponding degree, the diffusion in the span direction at the trailing edge 45 becomes insufficient as compared with the first embodiment. Therefore, in the flow velocity distribution at the trailing edge 45, the flow velocity in the vicinity of the middle in the span direction is higher than the flow velocities on the side of the hub 41 and on the side of the shroud 42.

In addition, the difference of the construction machine according to the second modification example of the first embodiment of the present invention illustrated in FIG. 21 from the first embodiment is that the position where the curvature at the vertex 43*v* of the curved convex shape of a blade 43 has the maximum curvature is not at a position near the middle in the chord direction (see FIG. 19) unlike the first embodiment, but near the leading edge 44. Specifically, the blade 43 is formed such that the curvature at the vertex of the convex shape described above gradually increases from the leading edge 44 toward the vicinity (the position of the black dot) of the leading edge 44. Additionally, the blade 43 is formed such that the curvature at the vertex of the convex shape described above gradually decreases from the vicinity (the position of the black dot) of the leading edge 44 toward the trailing edge 45. That is, the blade 43 includes: the first curved blade section on the side of the leading edge 44, the first curved blade section being a section lying from the leading edge 44 to the vicinity (the position of the black dot) of the leading edge 44, and the curvature at the vertex of the convex shape of the blade 43 gradually increases from the leading edge 44; and the second curved blade section on the side of the trailing edge 45, the second curved blade section being a section lying from the vicinity (the position of the black dot) of the leading edge 44 to the trailing edge 45, and the curvature at the vertex of the convex shape of the blade 43 gradually decreases toward the trailing edge 45.

In the present modification example, air having flowed into the centrifugal fan 31 can be gathered on the side of the vertex of the convex shape of the blade 43 in a process of reaching the vicinity (the position of the black dot) of the leading edge 44 from the leading edge 44. Thereby, it is possible to lower the flow rate of airflow moving toward the hub 41 due to turning a radially outward from the axis direction. Accordingly, non-uniform fan characteristics (see FIG. 15) in which flow rates become higher on the side of the hub 41 at the discharge port of the conventional centrifugal fan 131 can be improved.

It should be noted however that, in the present modification example, the position of the maximum curvature at the vertex of the convex shape of the blade 43 is displaced toward the leading edge 44 as compared with the first embodiment, and thus, by a corresponding degree, the advantage of lowering the flow rate of airflow moving toward the hub 41 when making a turn is reduced as compared with the first embodiment. Therefore, in the flow velocity distribution at the trailing edge 45, the flow velocity on the side of the hub 41 is higher than the flow velocity on the side of the shroud 42. However, the flow velocity difference between the side of the hub 41 and the side of the shroud 42 is mitigated as compared with the conventional centrifugal fan 131.

According to the construction machine according to the first modification example and the second modification example of the first embodiment of the present invention mentioned above, similarly to the advantages of the first embodiment mentioned before, it is possible to suppress the movement, toward the hub 41, of a flow of air having flowed to the leading edge 44 of a blade 43 of the centrifugal fan 31 due to an inertial force at the time of a turn. As a result, the flow velocity distribution in the span direction of the blade 43 in the centrifugal fan 31 can be mitigated.

Figure 22:
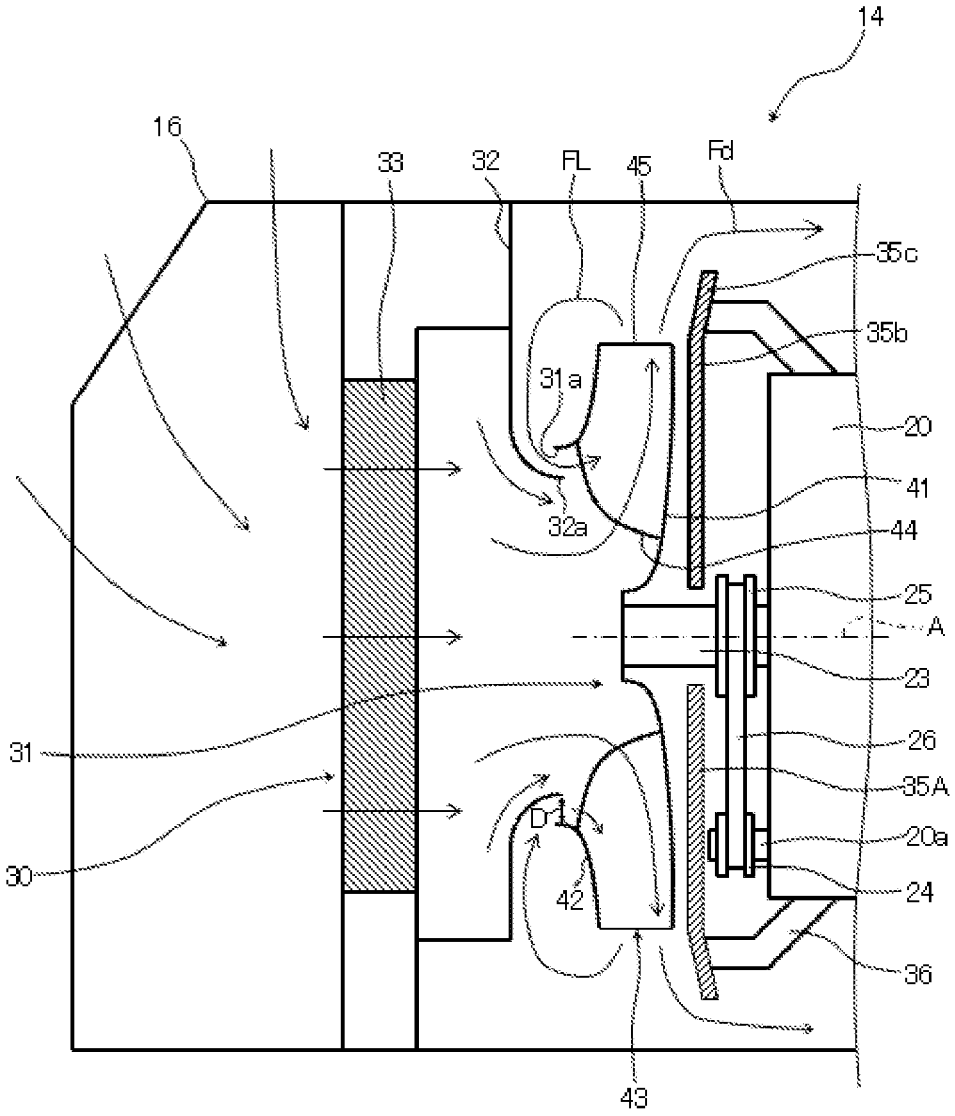
FIG. 22 is a cross-sectional view illustrating the inside of a machine room in a construction machine according to a second embodiment of the invention in a state in which part of the machine room is omitted.

Next, a construction machine according to a second embodiment of the present invention is explained by using FIG. 22. FIG. 22 is a cross-sectional view illustrating the inside of a machine room in the construction machine according to the second embodiment of the invention in a state in which part of the machine room is omitted. Note that in FIG. 22, those having reference characters which are the same reference characters as those illustrated in FIG. 1 to FIG. 21 are similar sections, and thus detailed explanations thereof are omitted.

The difference of the construction machine according to the second embodiment of the present invention illustrated in FIG. 22 from the first embodiment is that the shape of the rectifying member is different. Specifically, the rectifying member 35 in the first embodiment is an annular flat plate member (see FIG. 2). In contrast, a rectifying member 35A of the present embodiment is formed such that a portion on the radially outer side of the outer periphery of the centrifugal fan 31 is inclined in a direction away from the centrifugal fan 31 with respect to the radial direction of the centrifugal fan 31. That is, the rectifying member 35A includes an annular flat plate section 35*b* that extends in the radial direction on the radially inner side of the outer periphery of the centrifugal fan 31; and an annular inclined section 35*c* that is inclined from the outer periphery of the flat plate section 35*b* in a direction away from the centrifugal fan 31.

According to the construction machine according to the second embodiment of the present invention mentioned above, since a section on the radially outer side of the outer periphery of the centrifugal fan 31 in the rectifying member 35A is inclined in a direction away from the centrifugal fan 31 relative to the radial direction of the centrifugal fan 31, it is possible to cause part of the airflow Fd discharged from the centrifugal fan 31 and having been flowing in the radial direction to turn toward the axis direction, and a collision of the airflow Fd with the housing cover 16 can be mitigated.

Figure 23:
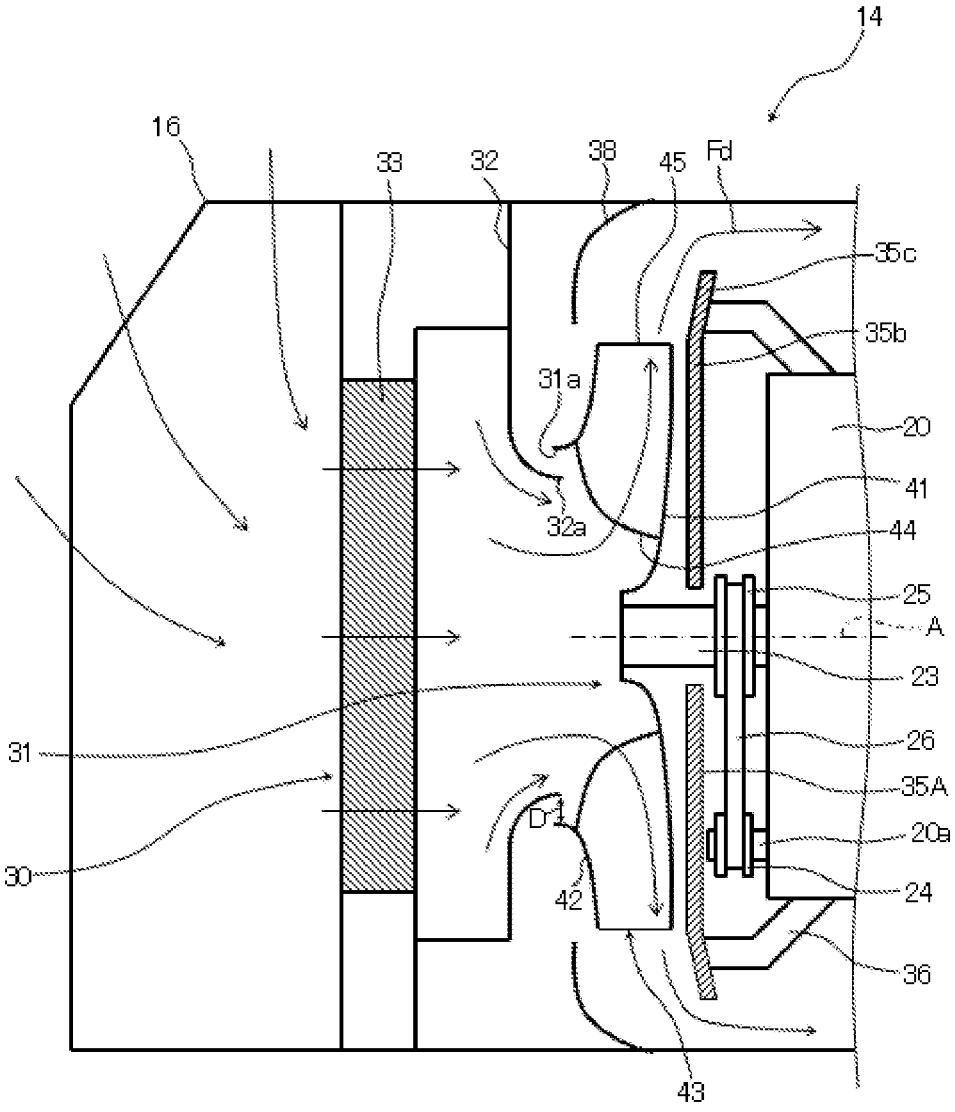
FIG. 23 is a cross-sectional view illustrating the inside of a machine room in a construction machine according to a third embodiment of the invention in a state in which part of the machine room is omitted.

Next, a construction machine according to a third embodiment of the present invention is explained by using FIG. 23. FIG. 23 is a cross-sectional view illustrating the inside of a machine room in the construction machine according to the third embodiment of the invention in a state in which part of the machine room is omitted. Note that in FIG. 23, those having reference characters which are the same reference characters as those illustrated in FIG. 1 to FIG. 22 are similar sections, and thus detailed explanations thereof are omitted.

The difference of the construction machine according to the third embodiment of the present invention illustrated in FIG. 23 from the second embodiment is that a second rectifying member 38 is additionally arranged on the side of the shroud 42 such that the second rectifying member 38 faces the rectifying member 35A. The second rectifying member 38 is formed such that it extends on the radially outer side of the outer periphery of the centrifugal fan 31, and a radially-outer-end portion of the second rectifying member 38 is positioned closer to the rectifying member 35A than a radially-inner-end portion of the second rectifying member 38 is. For example, the second rectifying member 38 is attached to the housing cover 16 positioned on the radially outer side of the centrifugal fan 31. The second rectifying member 38 forms an air guide path together with the rectifying member 35A, and guides the airflow Fd discharged from the centrifugal fan 31 in the radial direction such that the airflow Fd is turned in the axis direction and flows along the housing cover 16. The air guide path can also be formed as a diffuser for attempting to achieve pressure recovery, for example.

According to the construction machine according to the third embodiment of the present invention mentioned above, the second rectifying member 38 is arranged to face the rectifying member 35A, and the second rectifying member 38 is formed such that it extends radially outward from the outer periphery of the centrifugal fan 31, and the radially-outer-end portion of the second rectifying member 38 is positioned closer to the rectifying member 35A than the radially-inner-end portion of the second rectifying member 38 is. Accordingly, the airflow Fd discharged from the centrifugal fan 31 can be caused to turn in the axis direction, and the loss caused by a collision of the airflow Fd with the housing cover 16 can be reduced further.

Note that the present invention is not limited to the present embodiments, and includes various modification examples. The embodiments described above are explained in detail for explaining the present invention in an easy-to-understand manner, and are not necessarily limited to those including all the configurations explained. It is possible to replace some of configurations of an embodiment with configurations of another embodiment, and it is also possible to add configurations of an embodiment to configurations of another embodiment. In addition, addition, removal and replacement of other configurations are also possible about some of configurations of each embodiment.

For example, although the construction machine according to the present invention is applied to the hydraulic excavator 1 in the examples illustrated in the embodiments of the construction machine according to the present invention mentioned above, the present invention can be applied widely to various types of construction machine such as a hydraulic crane or a wheel loader.

In addition, in the example illustrated in the first embodiment mentioned above, each blade 43 is formed such that the curvature at the vertex 43*v* of the convex shape of the blade 43 gradually increases from the leading edge 44 toward a position near the middle in the chord direction, and gradually decreases from the position near the middle in the chord direction toward the trailing edge 45. However, each blade can also be formed such that the curvature at the vertex 43*v* of the convex shape of the blade 43 is kept the same from the leading edge 44 toward a position near the middle in the chord direction, and gradually decreases from the position near the middle in the chord direction toward the trailing edge 45. That is, each blade can also be formed such that it includes: the first curved blade section on the side of the leading edge 44, the first curved blade section being a section where the curvature at the vertex 43*v* of the convex shape of the blade 43 is kept the same from the leading edge 44; and the second curved blade section on the side of the trailing edge 45, the second curved blade section being a section where the curvature at the vertex 43*v* of the convex shape of the blade 43 gradually decreases toward the trailing edge 45.

In addition, in the examples illustrated in the first and second modification examples of the first embodiment mentioned above, each blade 43 is formed such that the curvature at the vertex 43*v* of the convex shape of the blade 43 gradually increases from the leading edge 44 toward the vicinity of the trailing edge 45 or the vicinity of the leading edge 44, and gradually decreases from the vicinity of the trailing edge 45 or the vicinity of the leading edge 44 toward the trailing edge 45. However, each blade 43 can also be formed such that the curvature at the vertex 43*v* of the convex shape of the blade 43 is kept the same from the leading edge 44 to the vicinity of the trailing edge 45 or the vicinity of the leading edge 44, and gradually decreases from the vicinity of the trailing edge 45 or the vicinity of the leading edge 44 toward the trailing edge 45.

In addition, although the rectifying members 35 and 35A, and the second rectifying member 38 are arranged around the entire circumference of the centrifugal fan 31 in the configurations (annular members) in the examples illustrated in the embodiments mentioned above, it is also possible to use the rectifying members and the second rectifying member that have configurations arranged only at part on the outer circumference side of the centrifugal fan 31, taking into consideration the installation spaces, manufacturing costs, ease of attachment and the like of the rectifying members 35 and 35A and the second rectifying member 38.

In addition, although the rectifying members 35 and 35A are fixed to the engine 20 via the stay 36 in the examples illustrated in the first and second embodiments mentioned above, the rectifying members can also be formed as part of the engine 20. It should be noted however that it is advantageous in terms of cost reduction, weight reduction and the like to fix the rectifying members 35 and 35A to the engine 20 by using the stay 36 because the installation space required can be made small.

In addition, although the engine 20 is used as a drive system of the centrifugal fan 31 in the examples illustrated in the embodiments mentioned above, it is also possible to use an electric motor, a hydraulic motor and the like as a drive system of the centrifugal fan 31.

DESCRIPTION OF REFERENCE CHARACTERS

1: Hydraulic excavator (construction machine)
3: Upper swing structure (machine body)
31: Centrifugal fan
31*a*: Suction port
32: Bell mouth
32*a*: Outlet
35, 35A: Rectifying member (first rectifying member)
38: Second rectifying member
41: Hub
42: Shroud
43: Blade
43*h*: Connection with the hub
43*s*: Connection with the shroud
43*v*: Vertex
44: Leading edge
44*h*: Connection with the hub
44*s*: Connection with the shroud
44*v*: Vertex
45: Trailing edge
46: Pressure surface
47: Suction surface
A: Rotation axis
R: Rotation direction

The invention claimed is:

1. A construction machine, comprising:
a centrifugal fan housed inside a machine body; and
a bell mouth arranged on a suction side of the centrifugal fan, the bell mouth having an outlet,
wherein
the centrifugal fan includes;
a hub that is rotatable around a rotation axis,
an annular shroud arranged so as to face the hub, the shroud forming a flow path between the shroud and the hub, the shroud having a suction port, and
a plurality of blades provided between the hub and the shroud at intervals in a circumferential direction,
each of the plurality of blades includes;
a leading edge on a side where air flows in,
a trailing edge on a side where air flows out,
a pressure surface that is one of blade surfaces extending between the leading edge and the trailing edge, the pressure surface facing forward relative to a rotation direction, and
a suction surface that is another of the blade surfaces extending between the leading edge and the trailing edge, the suction surface facing backward relative to the rotation direction,
the outlet of the bell mouth is arranged on a radially inner side of the suction port of the shroud,
each of the plurality of blades is formed such that:

the leading edge has a convex shape protruding toward the suction surface relative to a line segment linking a connection of the leading edge with the hub and a connection of the leading edge with the shroud, a vertex of the convex shape of the leading edge is positioned on a radially inner side of a wall surface of the outlet of the bell mouth when the suction side of the centrifugal fan is seen in an axis direction, the convex shape of the leading edge extends to the trailing edge, the suction surface is not concave, relative to a line segment linking a connection with the hub and a connection with the shroud in a cross-section taken along a cylindrical plane centered on the rotation axis, from the leading edge to the trailing edge, and a curvature at the vertex of the convex shape of each of the plurality of blades gradually increases from the leading edge toward a midway position disposed between the leading edge and the trailing edge and gradually decreases from the midway position toward the trailing edge.

2. A construction machine, comprising:

a centrifugal fan housed inside a machine body; and a bell mouth arranged on a suction side of the centrifugal fan, the bell mouth having an outlet, wherein the centrifugal fan includes;

a hub that is rotatable around a rotation axis, an annular shroud arranged so as to face the hub, the shroud forming a flow path between the shroud and the hub, the shroud having a suction port, and a plurality of blades provided between the hub and the shroud at intervals in a circumferential direction, each of the plurality of blades includes;

a leading edge on a side where air flows in, a trailing edge on a side where air flows out, a pressure surface that is one of blade surfaces extending between the leading edge and the trailing edge, the pressure surface facing forward relative to a rotation direction, and a suction surface that is another of the blade surfaces extending between the leading edge and the trailing edge, the suction surface facing backward relative to the rotation direction, the outlet of the bell mouth being arranged on a radially inner side of the suction port of the shroud, each of the plurality of blades is formed such that:

the leading edge has a convex shape protruding toward the suction surface relative to a line segment linking a connection of the leading edge with the hub and a connection of the leading edge with the shroud, a vertex of the convex shape of the leading edge is positioned on a radially inner side of a wall surface of the outlet of the bell mouth when the suction side of the centrifugal fan is seen in an axis direction, the convex shape of the leading edge extends to the trailing edge, and a curvature at the vertex of the convex shape of each of the plurality of blades is kept same curvature from the leading edge to a midway position disposed between the leading edge and the trailing edge and gradually decreases from the midway position toward the trailing edge.

3. The construction machine according to claim 1, further comprising:

a first rectifying member arranged across the centrifugal fan from the bell mouth, wherein the first rectifying member is a member extending radially outward at least from an outer periphery of the centrifugal fan.

4. The construction machine according to claim 3, wherein the first rectifying member is formed such that a portion of the first rectifying member lying on a radially outer side of the outer periphery of the centrifugal fan is inclined in a direction away from the centrifugal fan with respect to a radial direction.

5. The construction machine according to claim 3, further comprising:

a second rectifying member arranged so as to face the first rectifying member, wherein the second rectifying member is formed such that the second rectifying member extends radially outward from the outer periphery of the centrifugal fan, and a radially-outer-end portion of the second rectifying member is positioned closer to the first rectifying member than a radially-inner-end portion of the second rectifying member is, and the second rectifying member defines, together with the first rectifying member, an air guide path that guides airflow discharged from the centrifugal fan.

6. The construction machine according to claim 1, wherein each of the plurality of blades is formed such that:

a circumferential relative position of a connection with the shroud relative to a connection with the hub on a cross-section taken along a cylindrical plane centered on the rotation axis is displaced gradually backward, relative to the rotation direction, from the leading edge toward the trailing edge, and a circumferential position of a connection of the trailing edge with the shroud is displaced backward, relative to the rotation direction, from a circumferential position of a connection of the trailing edge with the hub.

* * * * *